US011585148B2

(12) United States Patent
Briese

(10) Patent No.: US 11,585,148 B2
(45) Date of Patent: Feb. 21, 2023

(54) MUNTIN ASSEMBLY AND METHOD OF MANUFACTURE

(71) Applicant: GED INTEGRATED SOLUTIONS, INC., Glenwillow, OH (US)

(72) Inventor: William A. Briese, Hinckley, OH (US)

(73) Assignee: GED Integrated Solutions, Inc., Glenwillow, OH (US)

( * ) Notice: Subject to any disclaimer, the term of this patent is extended or adjusted under 35 U.S.C. 154(b) by 303 days.

(21) Appl. No.: 16/785,724

(22) Filed: Feb. 10, 2020

(65) Prior Publication Data

US 2020/0256116 A1 Aug. 13, 2020

Related U.S. Application Data

(60) Provisional application No. 62/803,135, filed on Feb. 8, 2019.

(51) Int. Cl.
*E06B 3/68* (2006.01)
*B21B 1/38* (2006.01)

(52) U.S. Cl.
CPC ..... *E06B 3/685* (2013.01); *B21B 1/38* (2013.01)

(58) Field of Classification Search
CPC ..... E06B 3/6604; E06B 3/6675; E06B 3/68; E06B 3/685; B21B 1/38; Y10T 403/345
See application file for complete search history.

(56) References Cited

U.S. PATENT DOCUMENTS 3,686,814 A * 8/1972 Anderson ..... E06B 3/685 52/456
4,060,950 A * 12/1977 Rackard ..... E06B 3/685 52/456
4,628,582 A 12/1986 Leopold
4,723,388 A * 2/1988 Zieg ..... E06B 3/685 52/456
5,313,761 A 5/1994 Leopold
(Continued)

FOREIGN PATENT DOCUMENTS

DE 9013501 U1 * 1/1992 ..... E06B 3/6604
GB 1388820 A * 3/1975 ..... E06B 3/685
GB 2331541 A * 5/1999 ..... E06B 1/363

OTHER PUBLICATIONS

Sgaw Co., CRL/Somaca 3/4" Internal 4-Way Muntin Bar Joiners-3455935, [online] retrieved Jul. 24, 2020, available from internet, https://sgawinc.com/CRL-Somaz-3-4-Internal-4-Way-Muntin-Bar-Joiners-3455935.html (Year: 2020).
(Continued)

*Primary Examiner* — Christine T Cajilig
(74) *Attorney, Agent, or Firm* — Tarolli, Sundheim, Covell & Tummino LLP; John A. Yirga, Esq.

(57) ABSTRACT

A clip for supporting a muntin grid, a muntin grid, and a method of assembly is disclosed herein. The clip includes coupled together lateral and longitudinal members, each supporting bosses, and first and second arms respectively. The clip for coupling to the first and second muntin bars via first and second notches in the respective muntin bars. The muntin bars are formed by pre-notching and then roll forming, wherein the bosses support the first and second muntin bars when the clip is coupling the first muntin bar to the second muntin bar.

22 Claims, 20 Drawing Sheets

(56) References Cited

U.S. PATENT DOCUMENTS

| | | | | |
|---|---|---|---|---|
| 5,421,666 | A * | 6/1995 | Spears | B29C 66/244 403/176 |
| 5,678,377 | A | 10/1997 | Leopold | |
| 6,244,012 | B1 | 6/2001 | McGlinchy et al. | |
| 6,651,304 | B2 * | 11/2003 | McGlinchy | B21C 37/155 29/407.04 |
| 6,860,454 | B1 * | 3/2005 | Gronowicz, Jr. | F16B 2/10 248/67.7 |
| 6,883,278 | B2 | 4/2005 | McGlinchy et al. | |
| D561,102 | S | 2/2008 | Taneno et al. | |
| 8,001,742 | B2 | 8/2011 | Briese et al. | |
| 8,015,763 | B2 | 9/2011 | McGlinchy | |
| D741,688 | S | 10/2015 | James | |
| D773,293 | S * | 12/2016 | Ugartechea Berlanga | D8/382 |
| D793,848 | S | 8/2017 | Charette | |
| D799,719 | S | 10/2017 | Staton | |
| D826,692 | S | 8/2018 | Macdonald et al. | |
| 10,138,650 | B1 | 11/2018 | Garcia | |
| 10,329,832 | B2 | 6/2019 | Briese et al. | |
| D868,378 | S | 11/2019 | Hatchell | |
| D874,246 | S | 2/2020 | Stekr et al. | |
| 2009/0139164 | A1 | 6/2009 | Prete et al. | |
| 2015/0335151 | A1 | 11/2015 | Funfgeld | |
| 2019/0071919 | A1 | 3/2019 | McGlinchy et al. | |

OTHER PUBLICATIONS

Sgaw Co., CRL Internal Muntin Joiner for 36004 and 36006 Muntin—AM04, [online] retrieved Jul. 13, 2020, available from internet, https://sgawinc.com/CRL-Internal-Muntin-Joiner-for-36004-and-36006-Muntin-AM04.html (Year: 2020).

Fabryka Okien Vidawo, Szpros wiederiski (DUPLEX), Date first available 2014 [online] retrieved Jul. 24, 2020, available from internet, www.vidawo.pl (Year: 2014).

* cited by examiner

MUNTIN ASSEMBLY AND METHOD OF MANUFACTURE

CROSS REFERENCES TO RELATED APPLICATIONS

The following application claims priority under 35 U.S.C. § 119(e) to U.S. Provisional Patent Application Ser. No. 62/803,135 filed Feb. 8, 2019 entitled MUNTIN CROSS JOINER CLIP. The above-identified application is incorporated herein by reference in its entirety for all purposes.

TECHNICAL FIELD

The present disclosure relates to a muntin assembly and method of manufacture and more specifically a clip and decorative bars connected by the clip to form the muntin assembly that is used in residential and commercial windows. The disclosure further relates to the method of manufacturing the clip, bars, and their respective assembly. The clip being used to transversely connect the decorative bars in forming the assembly.

BACKGROUND

Windows constructed from multiple glass panes utilize decorative bars typically described as "muntins" or "muntin bars" to secure the edges of the individual glass panes within the window sash. In many windows, muntins formed distinctive grid patterns that are associated with architectural styles of buildings containing the windows.

Modern windows formed by insulating glass units utilize single glass lites separated by an insulating air space. Where a particular architectural "look" is desired, a grid of muntin bars is fixed on the window or even in the air space between the glass lites to simulate a multipane window. Typical muntin bars for insulating glass units are formed from decoratively coated interfitted metal tubes. The grids are anchored to the insulating glass unit periphery.

Muntin bar stock is produced by roll forming decoratively coated sheet material such as aluminum or steel, in a known manner. Various sizes of the sheet material are used to form different size muntin bar stock. The roll forming machine has a series of rolls configured to form sheet material into elongated tubular muntin bar stock. A window manufacturer purchases the muntin bar stock size(s) needed to produce insulating glass units, cuts the stock into lengths that are notched and assembled into grids for incorporation into the insulating glass units.

The cut-to-length muntin bars 2, 4 are then fed to a notching device to form notches 6, 8 that will be located at the muntin bar intersections. (see FIGS. 1-2). These muntin bars are cut after roll forming because a seam 10 formed from the roll forming is a point of "flare", where pre-notching to a depth 2A, 4A that is visually attractive (e.g., less than 50% of the overall thickness 2B, 4B of the muntin bar) would cause undesirable deformities.

The seam 10 is typically centrally located along a sidewall (i.e., not on a front or back wall that would comprise the simulated multipane window because the seam would be more visible on the front or back wall to someone looking in or out the window). To prevent undesirable shadowing 6A, 6B, 8A, 8B (see dashed lines in FIGS. 1-2) from a 50% or more notch depth, the depth 2A, 4A of each notch on each muntin bar 2, 4 has be individually assessed, and when needed for ascetics, manually altered. Further, an area 10*a* between the notch 6 and the seam 10 is fragile, and prone to breaking, as an average thickness (see dimension 28 is approximately three-sixteenths (3/16") of one inch. Although some machinery may be specialized to notch the bars for forming grids, the muntin bars must typically be manually handled to produce correctly sized muntin bars with properly located notches.

Muntin bars are typically coupled together by clips. A known clip typically has a first muntin bar engagement leg extending from one end of the body and a second muntin bar engagement leg extends from an opposite end of the body. The muntin bar engagement legs extend along a longitudinal axis of the clip and the one or more abutments extend from the body transverse to the axis. The joiner has opposite body sides that define substantially parallel major surfaces and opposite edges that are substantially parallel and extend substantially parallel to the axis. Different embodiments are disclosed in which the abutments extend from body sides or body edges.

Further discussion relating to developments in window clips and cross joiner clips are discussed in U.S. Pat. Nos. 4,628,582; 5,313,761; 5,678,377; 6,244,012; 6,651,304; 6,883,278; 8,001,742 and 8,015,763. U.S. Pat. Nos. 4,628,582; 5,313,761; 6,678,377; 6,244,012; 6,651,304; 6,883,278; 8,001,742 and 8,015,763 are assigned to the assignee of the present application and all of the aforementioned patents are incorporated herein by reference in their entirety for all purposes.

SUMMARY

One example embodiment of the present disclosure includes a muntin clip comprising: a body having a longitudinal member and a lateral member, the longitudinal member overlapping said lateral member at a generally central location; first and second arms at first and second ends of said longitudinal member and lateral member, said first and second arms diverging on said longitudinal member from said first and second arms on said lateral member; and a boss located on one of said lateral member and said longitudinal member.

Another example embodiment of the present disclosure includes a method of forming a muntin grid, the method comprising the steps of pre-notching a flat strip to form a first and second pre-notched strips, roll forming the first and second pre-notched strips to from a first and second muntin bars defining first and second notches, respectively, the first and second muntin bars defining a contoured shape comprising first and second lateral sections coupled together and spaced by a raised central section, and inserting a lateral member of a clip into the first notch and coupling the clip to the first muntin bar, the clip having centrally linked lateral and longitudinal members, the lateral member extending along a lateral axis, the longitudinal member extending along a longitudinal axis, the lateral member supporting first and second lateral arms and the longitudinal member supporting first and second longitudinal arms the first and second lateral arms extend along a third axis in a first direction and the first and second longitudinal arms extend along the third axis in a second direction, the first direction opposite the second direction and the longitudinal, lateral and third axis are perpendicular to each other, the longitudinal member coupled to a second boss spaced and directly opposed to a first boss supported by the lateral member, the second boss and the first boss extend away from each other along the third axis. The method further includes inserting the longitudinal member into the second notch to couple the first muntin bar to the second muntin bar, wherein the first boss is in contact with a first internal surface of the first muntin bar, and the second boss is in contact with a first internal surface of the second muntin bar when the first muntin bar is coupled to the second muntin bar by the clip.

Yet another example embodiment of the present disclosure includes muntin grid comprising a clip and first and second muntin bars. The clip comprising centrally linked lateral and longitudinal members, the lateral member extending along a lateral axis, the longitudinal member extending along a longitudinal axis, first and second lateral arms supported by the lateral member and first and second longitudinal arms supported by the longitudinal member, the first and second lateral arms extend along an arm axis in a first direction and the first and second longitudinal arms extend along the arm axis in a second direction, the first direction opposite the second direction and the longitudinal, lateral and arm axes are perpendicular to each other, and a second boss coupled to the longitudinal member, the second boss spaced and directly opposed to a first boss supported by the lateral member, the second boss and the first boss extend away from each other along the third axis. The first muntin bar defines a contoured shape comprising first and second lateral sections coupled together and spaced by a raised central section, a first notch defined in the first muntin bar, the clip frictionally retained in the first notch, wherein the first boss and the first and second lateral arms are in contact with internal surfaces of the first muntin bar. The second muntin bar defines a contoured shape comprising first and second lateral sections coupled together and spaced by a raised central section, a second notch defined in the second muntin bar, the clip frictionally retained in the second notch, wherein the second boss and the first and second longitudinal arms are in contact with internal surfaces of the second muntin bar, the clip being frictionally retained in the first and second notches couples the first and second muntin bars together.

BRIEF DESCRIPTION OF THE DRAWINGS

The foregoing and other features and advantages of the present disclosure will become apparent to one skilled in the art to which the present invention relates upon consideration of the following description of the invention with reference to the accompanying drawings, wherein like reference numerals refer to like parts unless described otherwise throughout the drawings and in which.

Figure 1:
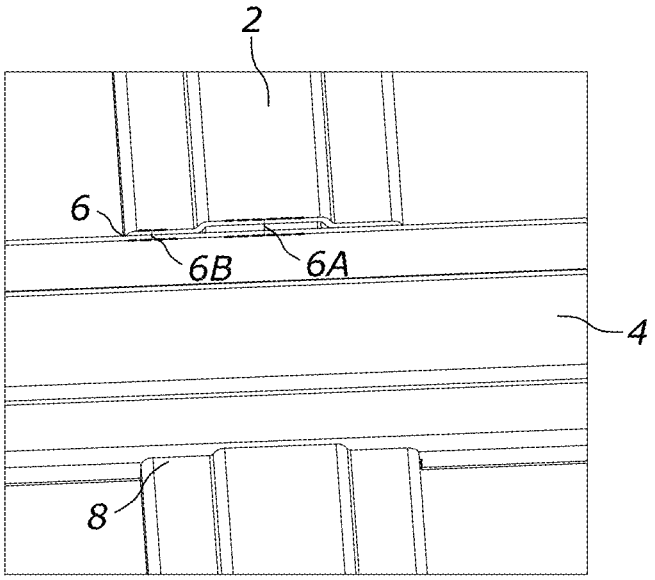
(PRIOR ART) FIG. 1
FIG. 1 is a top perspective view of a prior art muntin cross using a prior art joiner clip.
Figure 2:
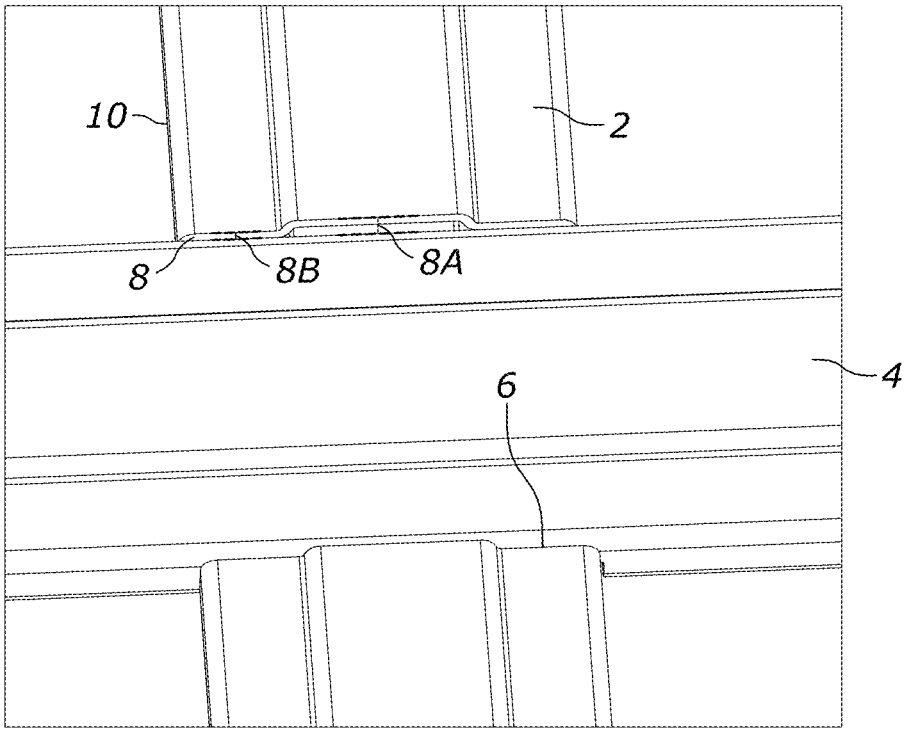
(PRIOR ART) FIG. 2
FIG. 2 is a magnified view of FIG. 1.
Figure 2A:
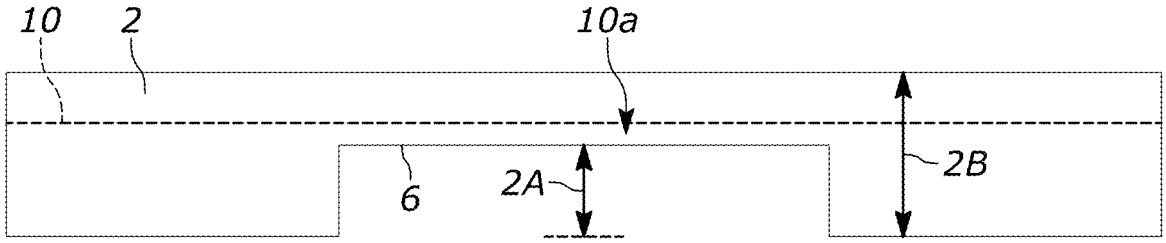
FIG. 2A is a side elevation view of a prior art first muntin bar for use with a prior art joiner clip.
Figure 2B:
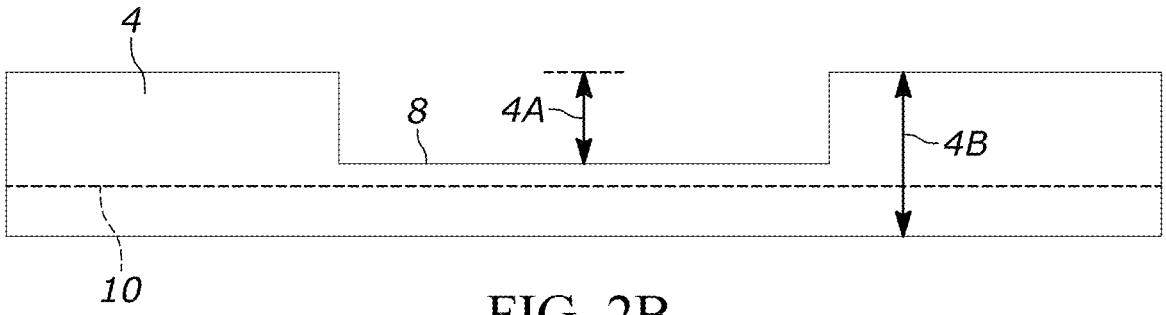
FIG. 2B is a side elevation view of a prior art first muntin bar for use with a prior art joiner clip.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements throughout unless otherwise noted. The present disclosure relates to a muntin assembly and method of manufacture and more specifically a clip and decorative bars connected by the clip to form the muntin assembly that is used in residential and commercial windows. The disclosure further relates to the method of manufacturing the clip, bars, and their respective assembly. The clip being used to transversely connect the decorative bars in forming the assembly.

FIGS. 3-10, 11B 12B, 13A-17 illustrates a muntin cross joiner clip 100 constructed in accordance with one example embodiment of the present disclosure. The muntin cross joiner clip 100 illustrated in FIGS. 3-10, 11B-12B, 13A-17 (hereinafter clip) includes a longitudinal member 102 and a lateral member 112, wherein the longitudinal member and the lateral member overlap to form a cross transverse to each other. In another example embodiment, the clip 100 is made as a single molded element from a polymer such as plastic. While yet in another example embodiment, the longitudinal member 102 and lateral member 112 are transverse to a point where both members are substantially orthogonal to each other.

In the illustrated example embodiment, the longitudinal member 102 and the lateral member 112 overlap at a generally central location 122. In another example embodiment, the longitudinal member 102 and the lateral member 112 are perpendicular to each other, wherein the lateral member 112 extends along an x-axis and the longitudinal member 102 extends along a y-axis. The longitudinal member 102 and the lateral member 112 are coupled together at the generally central location 122 by integrally molding the longitudinal member and lateral members together during a molding operation when forming the clip 100 such that separation of the two members would destroy the clip. In one example embodiment, the longitudinal member 102 and the lateral member 112 have a same or different width and a same or different length.

Figure 8:
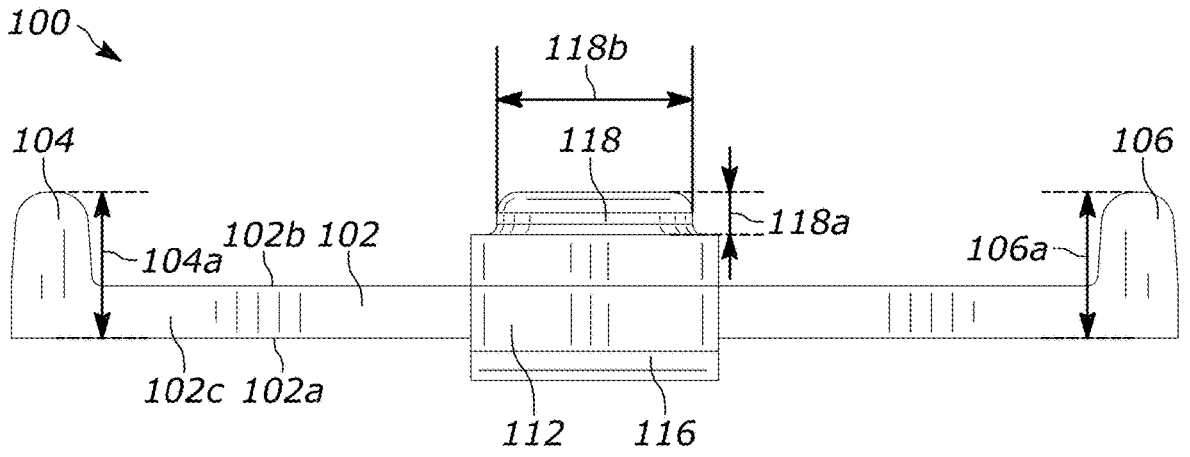
FIG. 8 is a front elevation view thereof, the rear side elevation view being a mirror image.

As shown in the illustrated example embodiment of FIG. 8, the longitudinal member 102 has a contact surface 102*a* and a non-contact surface 102*b*, the contact and non-contact surfaces spaced by side surfaces 102*c*. As shown in the illustrated example embodiment of FIG. 7, the lateral member 112 has a contact surface 112*a* and a non-contact surface 112*b*, the contact and non-contact surfaces spaced by side surfaces 112*c*. The non-contact surface 102*b* of the longitudinal member 102 is molded with, or coupled to the non-contact surface 112*b* of the lateral member 112 when the members are connected at the generally central location 122 during the molding operation of the clip 100.

Figure 3:
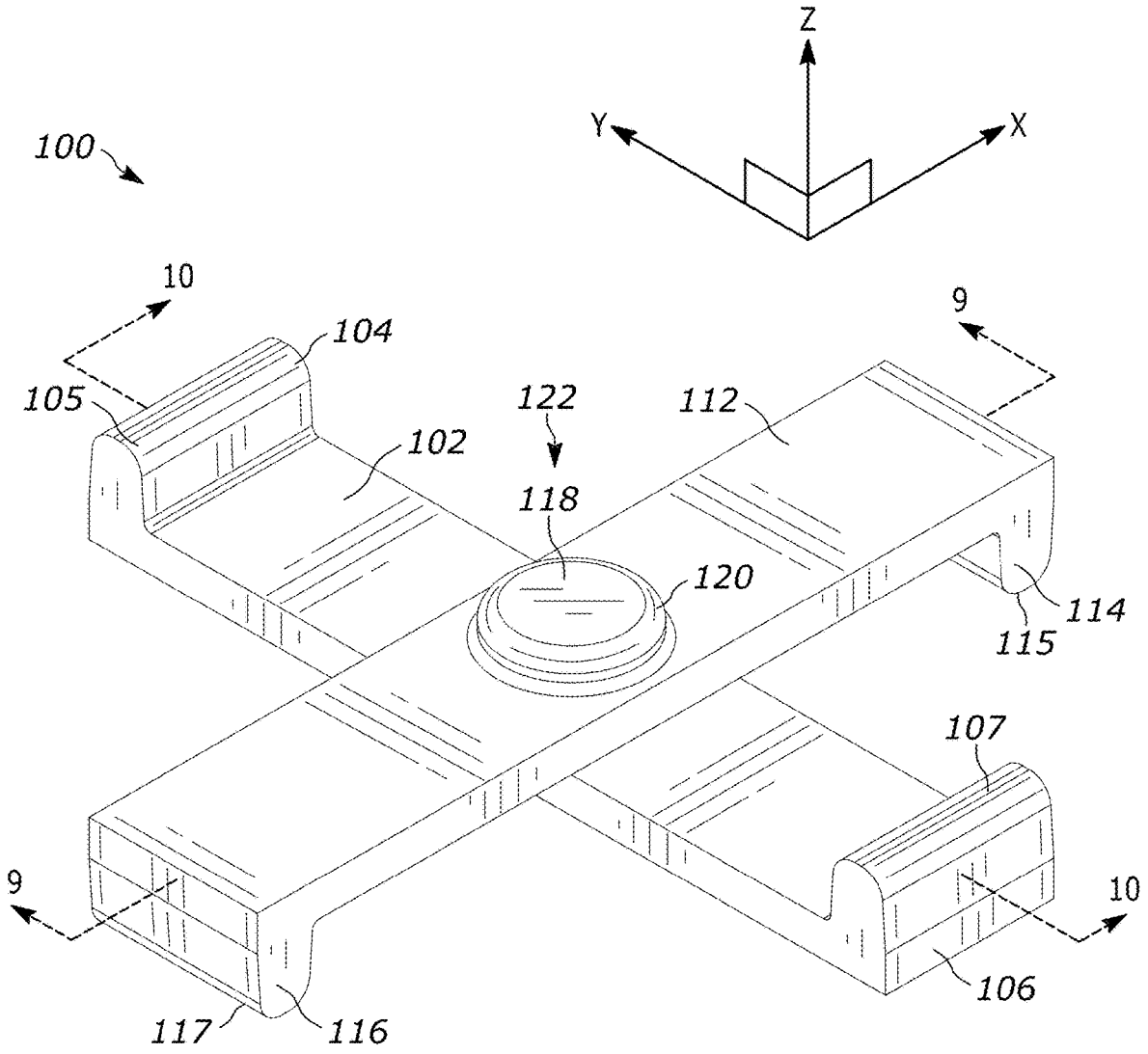
FIG. 3 is a top perspective view of a MUNTIN CROSS JOINER CLIP in accordance with one example embodiment of the present disclosure.

As shown in the illustrated example embodiment of FIG. 3, the longitudinal member 102 has first and second arms 104, 106 that extend in a first direction, along a z-axis. The first and second arms 104, 106 extend from the non-contact surface 102*b*, away from the contact surface 102*a*. The lateral member 112 has first and second arms 114, 116 that extend in a second direction along the z-axis from the non-contact surface 112*b*. In one example embodiment, the first and second directions are opposite or one-hundred-and-eighty-degrees (180°) of each other. Illustrated in the example embodiment of FIGS. 7-8, the arms 104, 106, 114, 116 extend a first, second, third, and fourth arm distances 104*a*, 106*a*, 114*a*, 116*a*, respectively from the contact surfaces 102*a*, 112*b* of the respective members 102, 112. The arms 104, 106, 114, 116 end in respective first, second, third and fourth edges or surfaces 105, 107, 115, 117. In one example embodiment the first and second arm distances 104*a*, 106*a* have a height of 0.130" inches and a range between +1-0.005" inches and the third and fourth arm distances 114*a*, 116*a* have a height of 0.130" inches and a range between +/−0.005" inches. While yet in another example embodiment, the arm heights and/or arm distances 104*a*, 106*a*, 114*a* and 116*a* are substantially the same within plus or minus five thousands of one inch (+/−0.005").

Figure 12A:
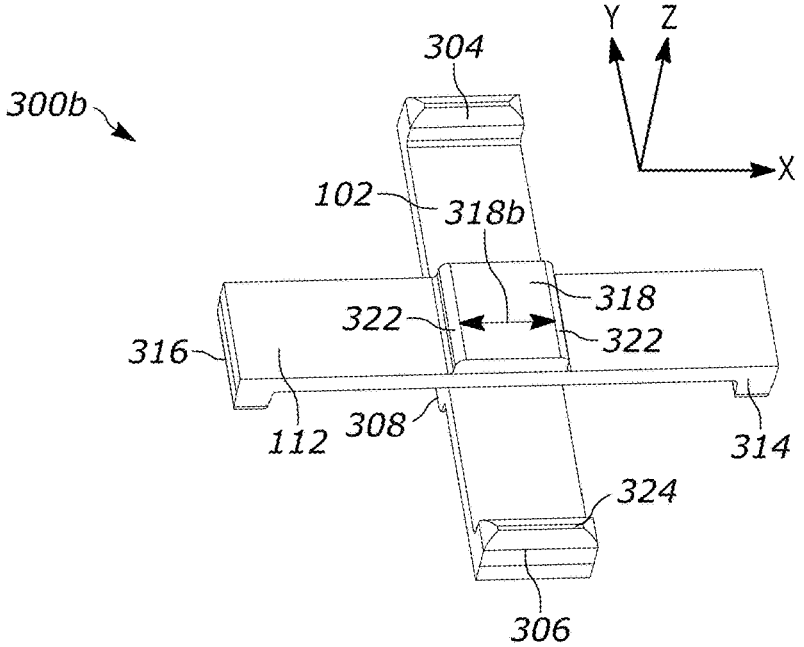
FIG. 12A is a top perspective view of a muntin cross joiner clip in accordance with third example embodiment of the present disclosure.
Figure 12B:
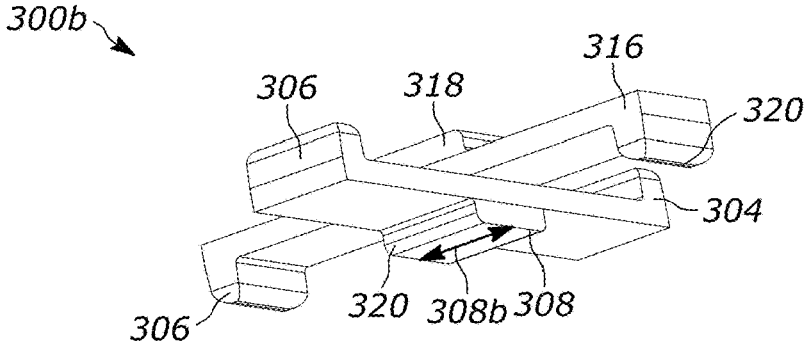
FIG. 12B is a bottom perspective view of a muntin cross joiner clip in accordance with a third example embodiment of the present disclosure.
Figure 12C:
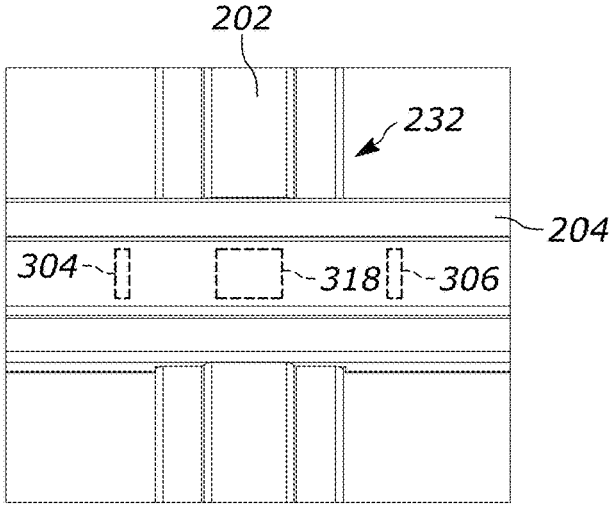
FIG. 12C is a perspective view of assembled muntin bars cross joined by the muntin cross joiner clip partially shown in dashed lines.
Figure 13B:
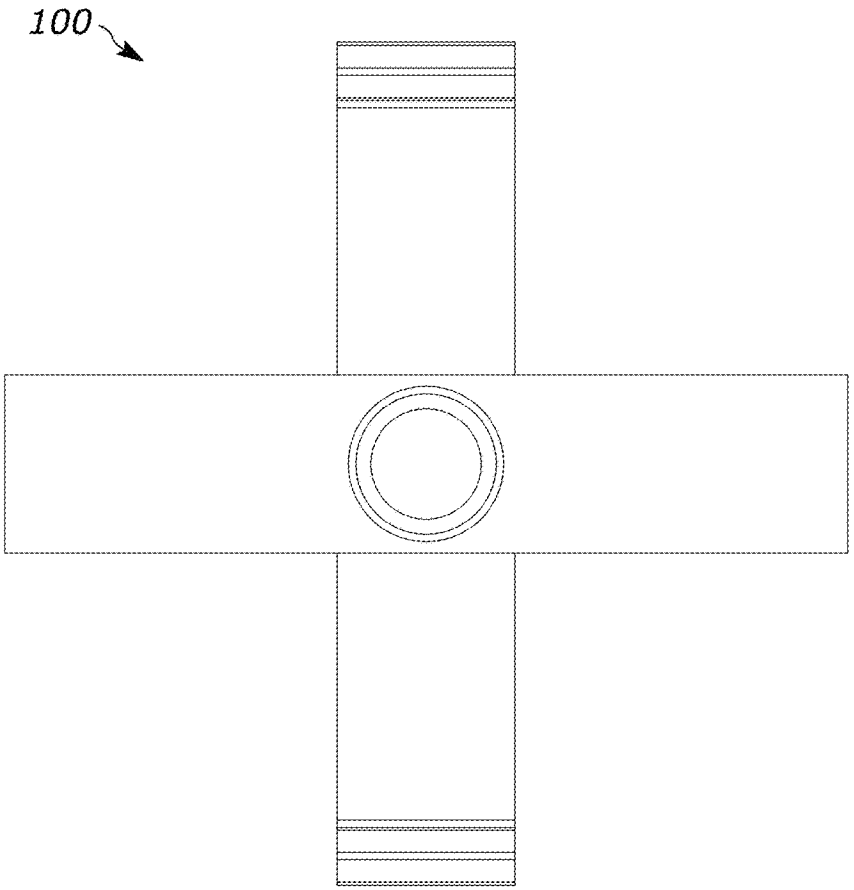
FIG. 13B is a bottom plan view of a muntin cross joiner clip in accordance with a third example embodiment of the present disclosure.
Figure 13A:
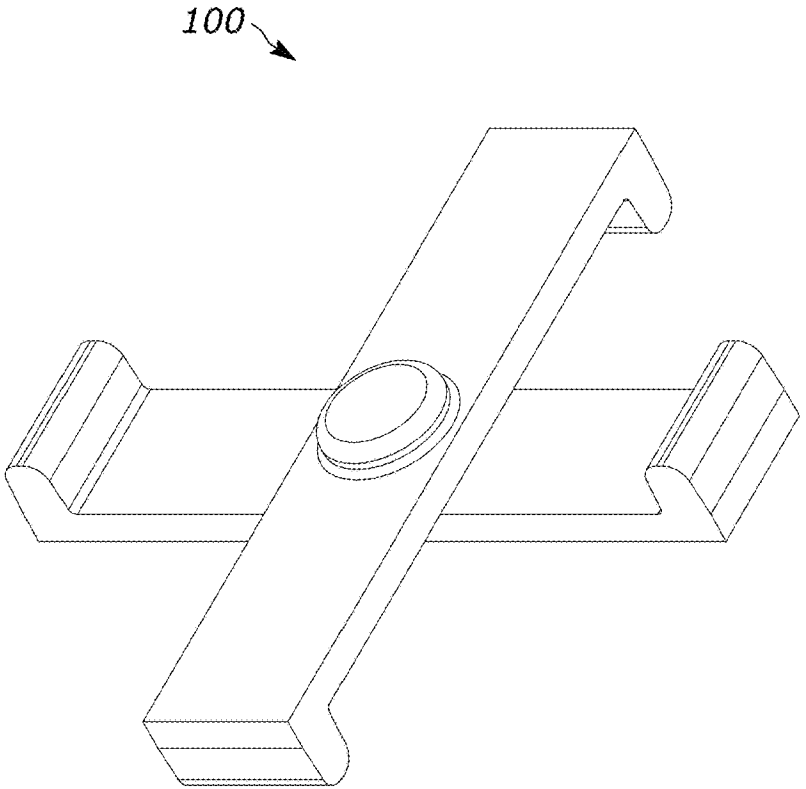
FIG. 13A is a bottom perspective view of a muntin cross joiner clip in accordance with an example embodiment of the present disclosure.
Figure 14B:
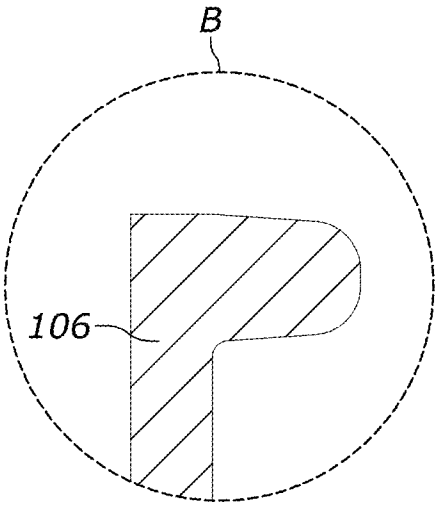
FIG. 14B is a magnified view of circle B in FIG. 14.
Figure 14A:
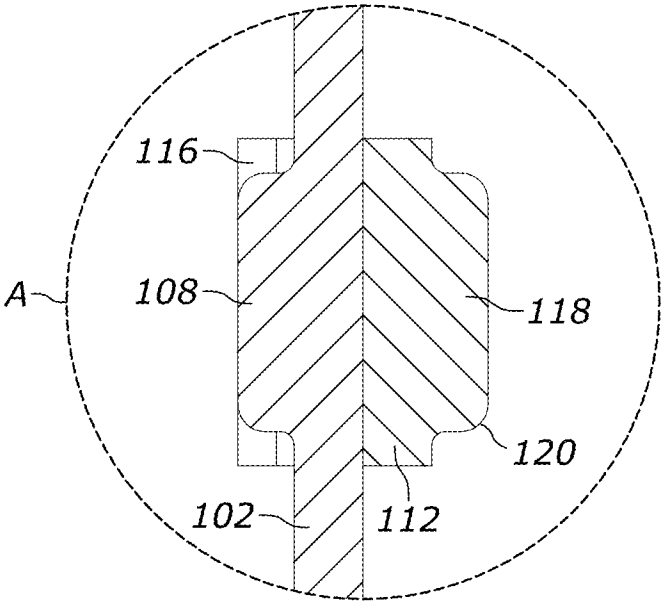
FIG. 14A is a magnified view of circle A in FIG. 14.
Figure 14:
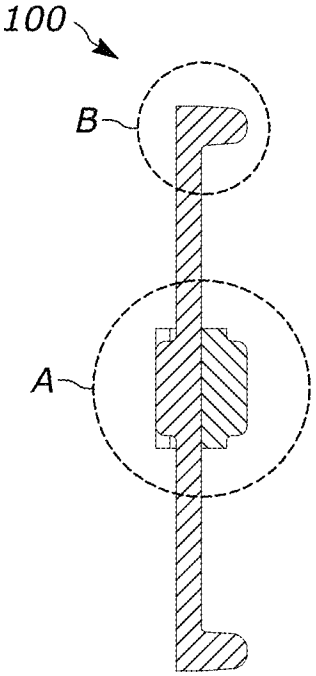
FIG. 14 is a front elevation section view of FIG. 1 along section lines 8-8.
Figure 18:
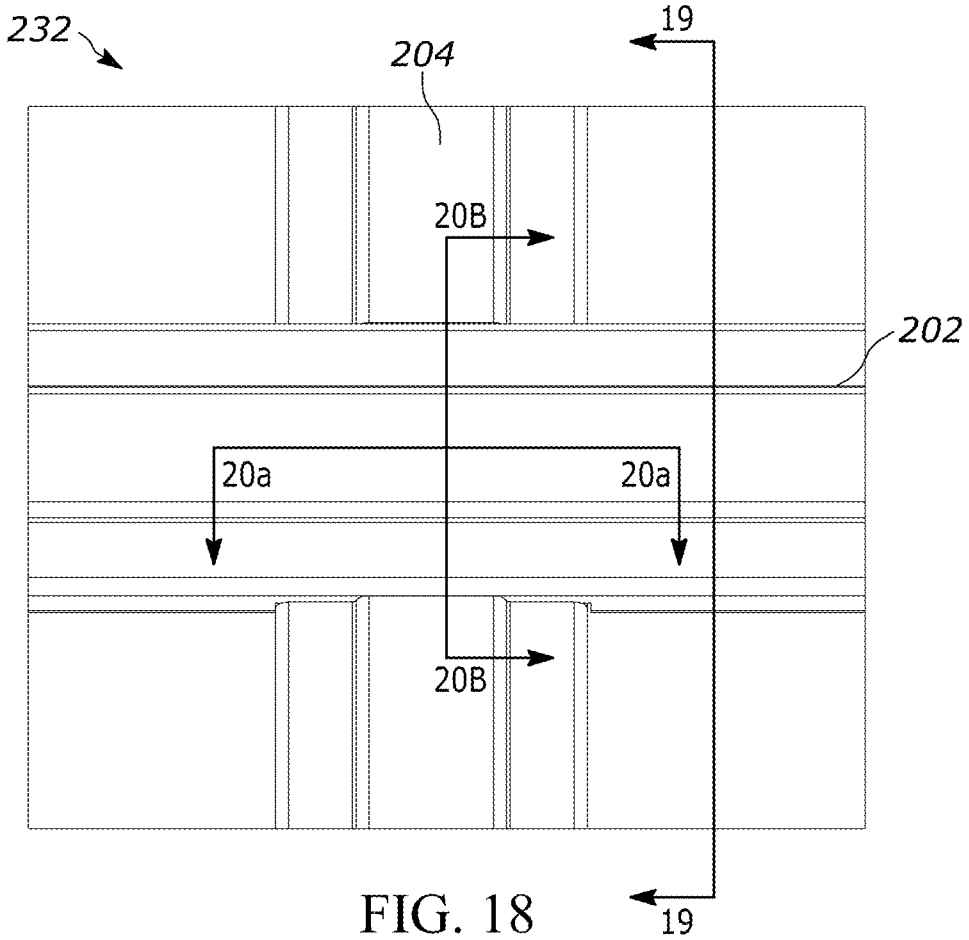
FIG. 18 is a perspective view of assembled muntin bars cross joined by the muntin cross joiner clip.

The clip 100 is configured to couple first and second muntin bars 202, 204 at a joint 230 together for form a grid 232 in a window unit, as illustrated for example in FIGS. 12C and 18. As shown in the illustrated example embodiment of FIGS. 11A, 18, 19, 19A, 19B and 19C, the muntin bar 202, 204 is formed from a supply of sheet material having a finished surface on at least one side in the form of a coiled ribbon 201. The coiled ribbon is unwound and fed along a strip path 402 of travel to a punch station 403.

At the punch station 403, a ribbon punching mechanism punches the ribbon at a precisely predetermined locations along the ribbon to form one of a plurality notch patterns that define a portion of a contoured muntin bar. The notches 204, 206 that are punched are approximately 50% of an overall thickness (or width see FIGS. 19A and 19B) of the metal strip. In another example embodiment, the notches 204 and 206 are exactly 50% the overall thickness (or width) of the metal strip such that the punch depth is to the seam from the edge extending to half of the material such that when the material is roll formed, the notch is on the seam and symmetrically opposite the seam.

Figure 19:
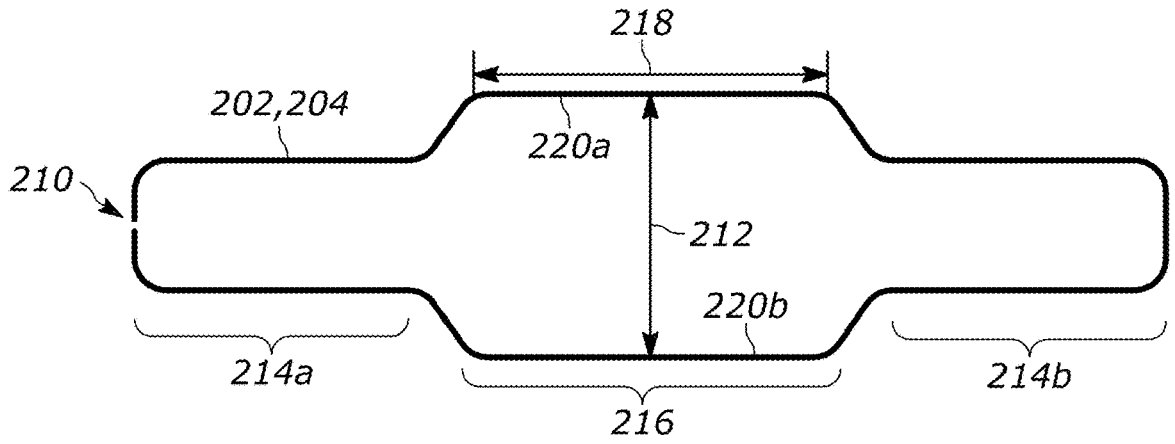
FIG. 19 is a cross-section view of FIG. 18 taken along section line 19-19.
Figure 19A:
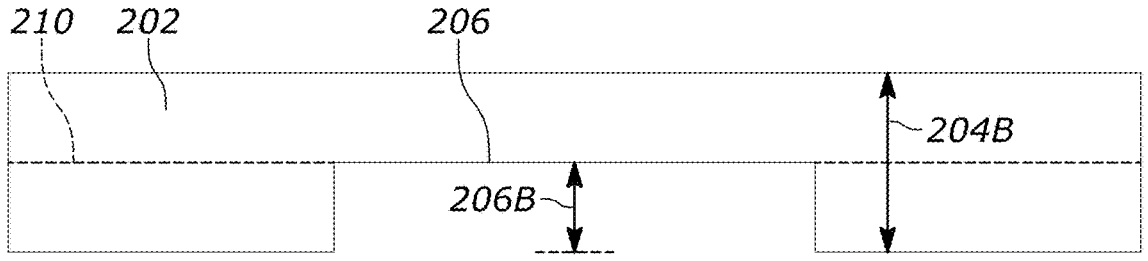
FIG. 19A is a side elevation view of a first muntin bar.
Figure 19B:
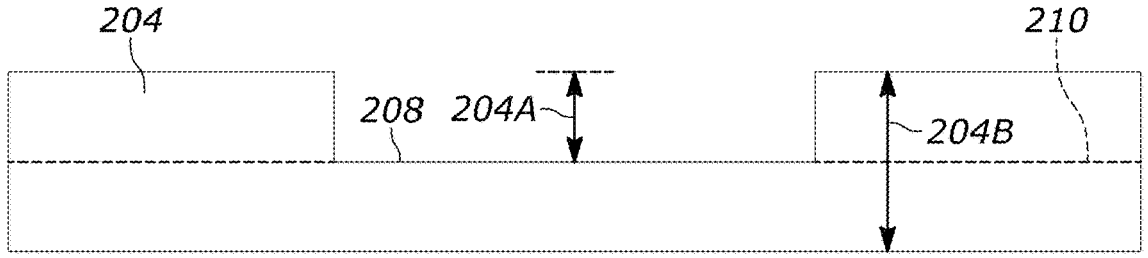
FIG. 19B is a side elevation view of a second muntin bar.
Figure 19C:
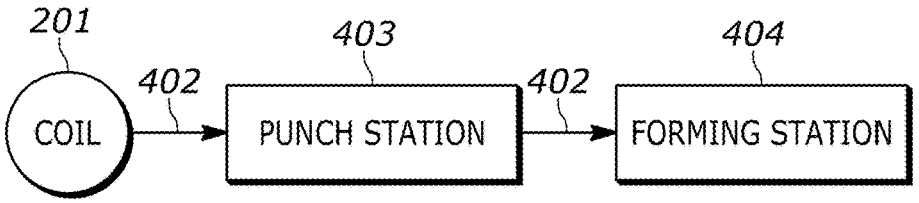
FIG. 19C is a schematic diagram of flow path including a punching station and a forming station, according to one example embodiment.

Downstream along the travel path 402 from the punch station 403 the ribbon/coil 201 is fed through a forming station 404 having a succession of forming rolls that define a succession of forming roll nips to bend the ribbon and form a generally closed cross-sectional tube (see FIG. 19). The roll forming operation that forms the generally closed cross-sectional tube includes forming a centrally located seam 210, wherein the sheet metal reconnects with itself (or into contact with opposite sides of the strip). The location of the seam 210 will correspond with a lateral end to a fully formed notch 206, 208 in a complete muntin bar 202, 204. The rolls form a number of bending stages to produce a muntin bar tube having a contoured shape with lateral sections 214*a*, 214*b* coupled together and spaced by a raised central section 216 to provide an attractive appearance to a muntin grid 232.

In one example embodiment, the central section 216 of the muntin bar 202 defines a central height 212. In another example embodiment, the central height 212 is at 0.014" inches with a range of +/−0.005" inches. The central section 216 further defines a central width 218, wherein the central width comprises the width in which the muntin bar 202 maintains the central height 212. The muntin bars 202, 204 define first and second internal surfaces 220*a*, 220*b*. The first and second internal surfaces 220*a*, 220*b* are defined within the central section 216, wherein the first and second internal surfaces 220*a*, 220*b* face each other or mirror each other.

In one example embodiment, the first, second, third, and fourth arm distances 104*a*, 106*a*, 114*a*, 116*a* correspond to the central height 212 of the muntin bar 202 in which the clip 100 will be used. (see FIG. 19). In one example embodiment, the first, second, third, and fourth arm distances 104*a*, 106*a*, 114*a*, 116*a* are between 0.1% to 10% less than the central height 212. In another example embodiment, the first and second arm distances 104*a*, 106*a* are different from the third and fourth arm distances 114*a*, 116*a*, wherein, a first side of muntin bar 202 extends farther than a second side of the muntin bar 202 (e.g., to have different grid 232 designs on opposing sides of a window frame). In this example embodiment, the arms 104, 106, 114, 116 comprise rounded edges.

Figure 4:
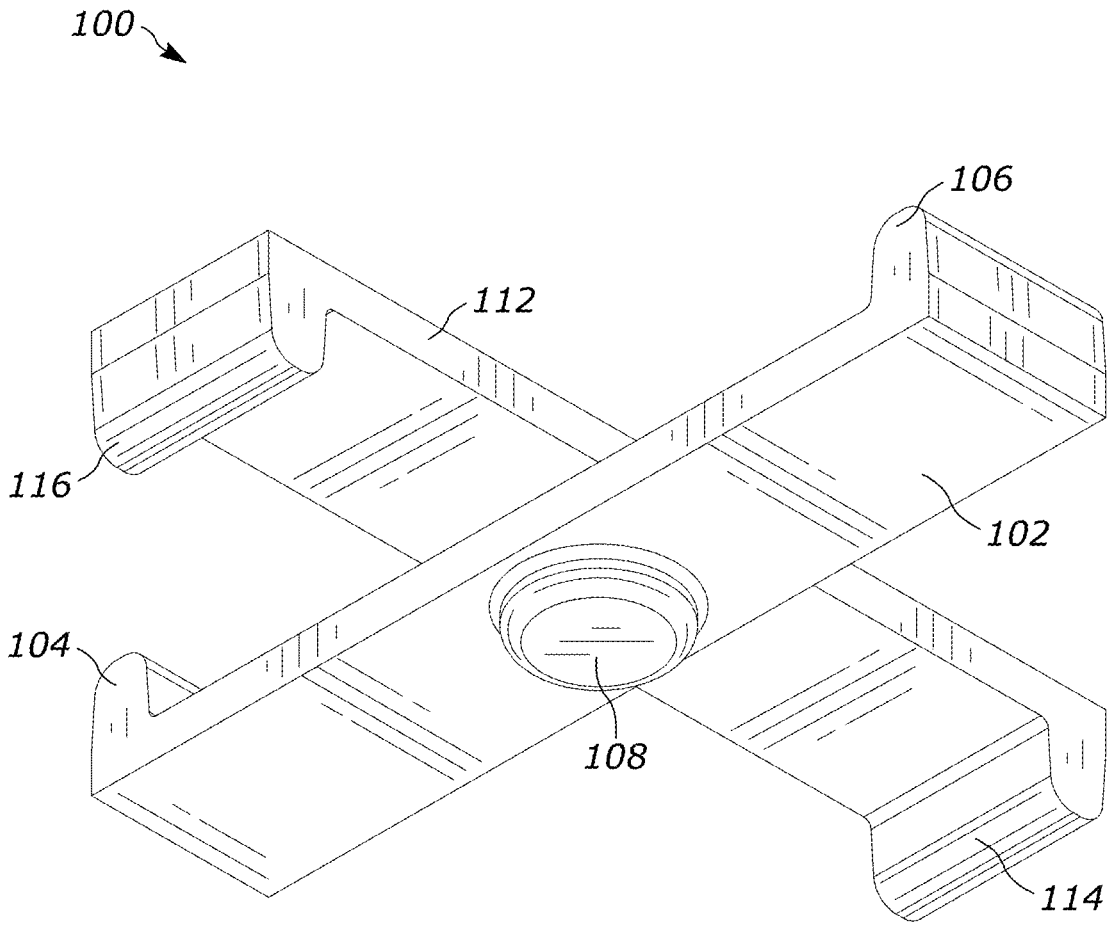
FIG. 4 is a bottom perspective view thereof.
Figure 5:
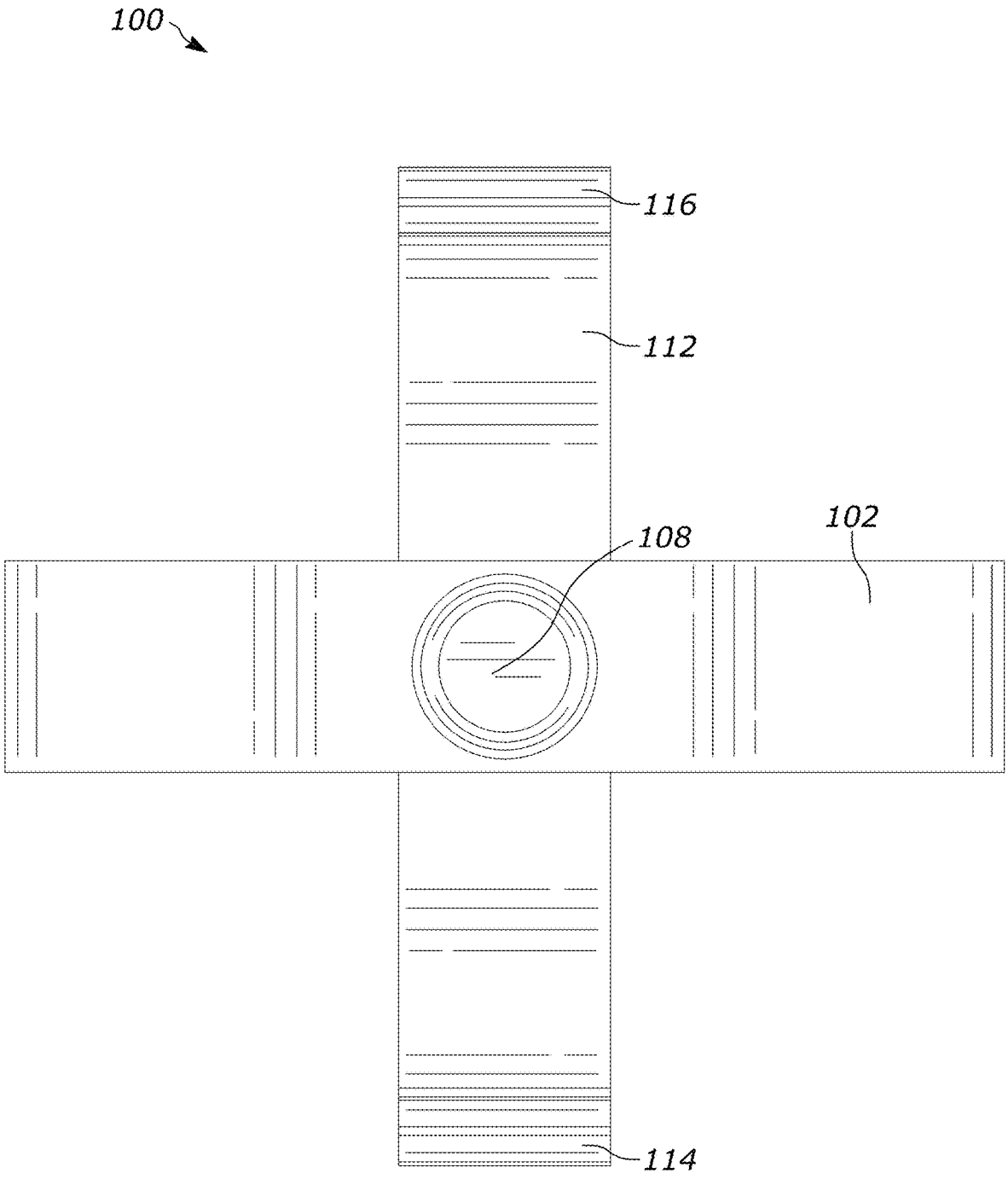
FIG. 5 is a bottom plan view thereof.
Figure 6:
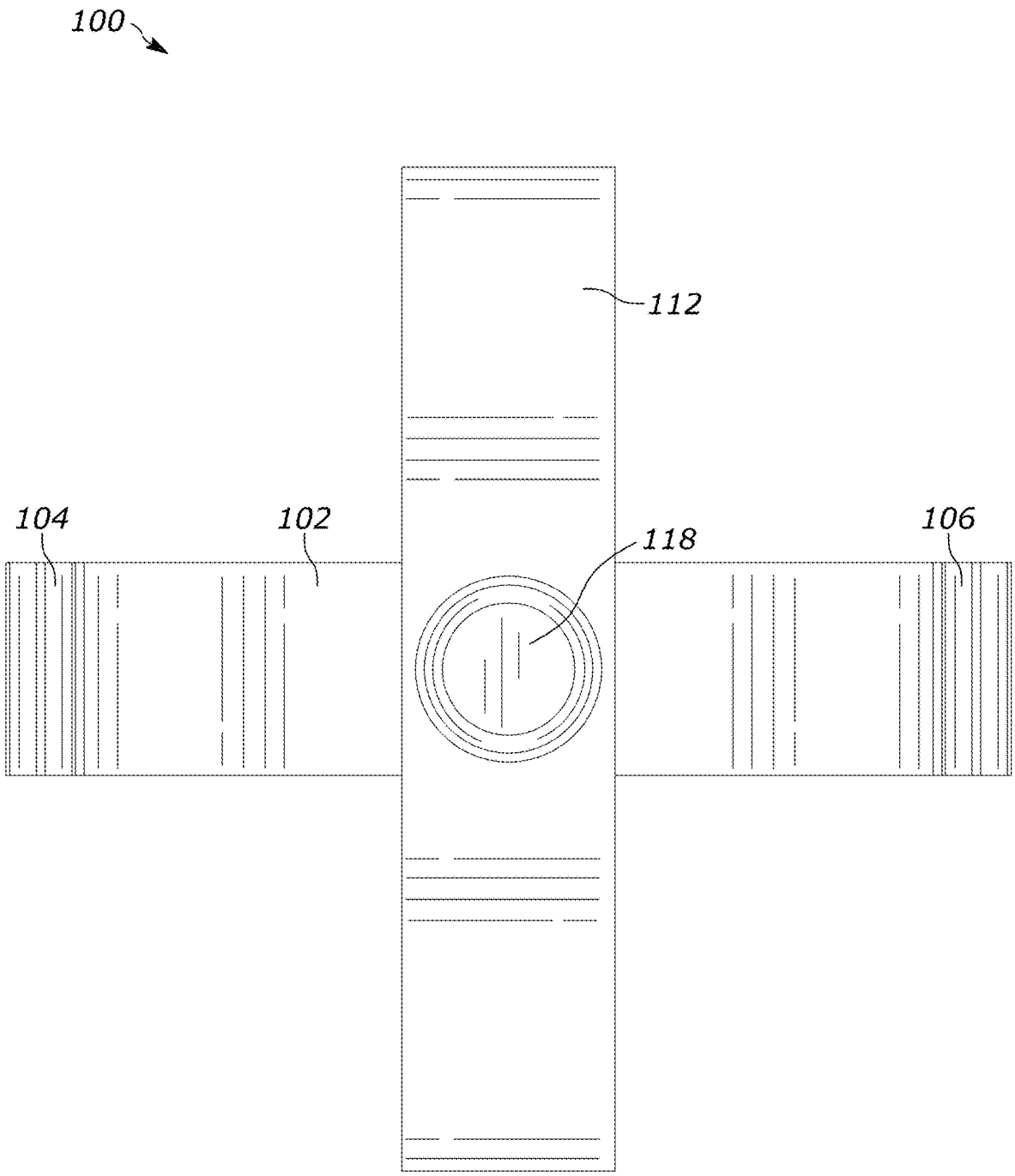
FIG. 6 is a top plan view thereof.
Figure 7:
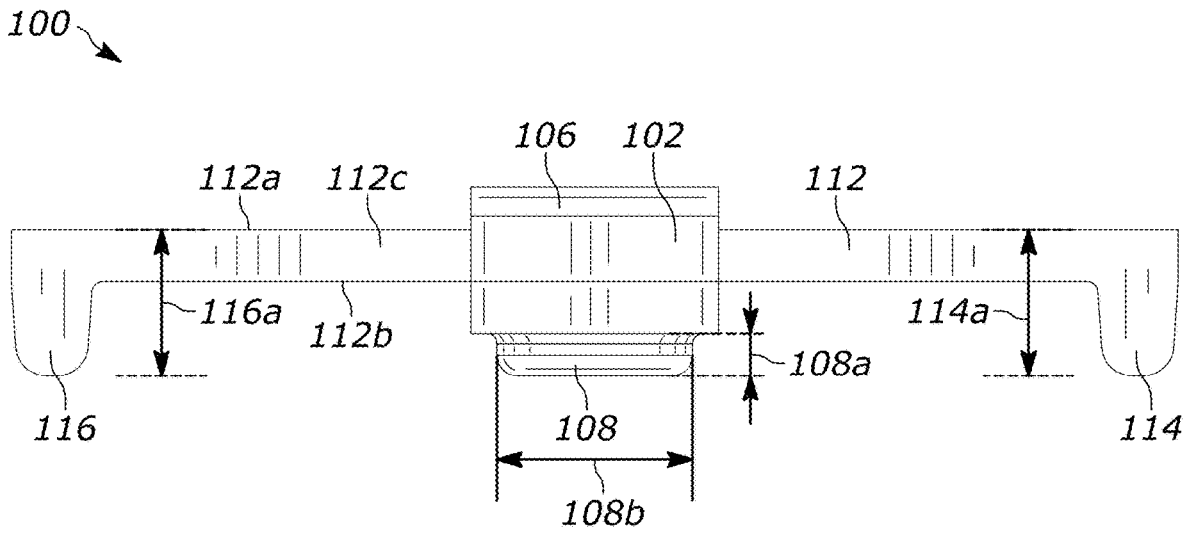
FIG. 7 is a right-side elevation view thereof, the left side elevation view being a mirror image.

As illustrated in FIGS. 3 and 4, a first boss 108 and a second boss 118 extend from the contact surfaces 102*a*, 112*a*, respectively, of the longitudinal and lateral members 102, 112. In one example embodiment, the first boss 108 extends along the z-axis along the second direction, and the second boss 118 extends along the z-axis in the first direction. In yet another example embodiment, the first and second bosses extend from the contact surfaces 102*a*, 112*a*, respectively. As illustrated in the example embodiments of FIGS. 7-8, the first boss 108 has a first boss height 108*a*, and the second boss 118 has a second boss height 118*a*. In one example embodiment, the first boss height 108*a* is 0.045" inches having a range between +/−0.005" inches and the second boss height 118*a* is 0.045" inches having a range between +/−0.005" inches. In one example embodiment, the first and second boss heights 108*a*, 118*a* are the same height. In another example embodiment, the first and second boss heights 108*a*, 118*a* are different heights. In one example embodiment, the first and second boss heights are different responsive to the first and second arm distances 104*a*, 106*a* being different from the third and fourth arm distances 114*a*, 116*a*. In this illustrated example embodiment, the first and second bosses 108, 118 are round.

In the illustrated embodiment, the first and second bosses 108, 118 have beveled edges 120. In another example embodiment, a top surface of the first and second bosses 108, 118 has a diameter that is less than a diameter of a contact surface of the first and second bosses 108, 118 that is coupled to the contact surface 102*a*, 112*a* of the clip 100. In yet another example embodiment, the top surface of the first and second bosses 108, 118 has a diameter greater than or equal to the diameter of the contact surface of the first and second bosses.

Figure 9:
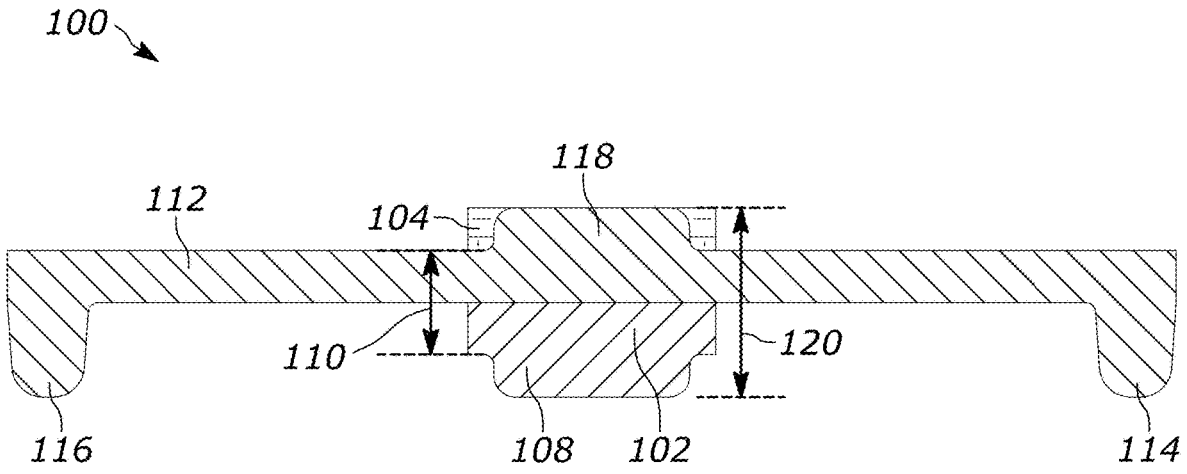
FIG. 9 is a right-side elevation section view of FIG. 1 along section lines 7-7.
Figure 10:
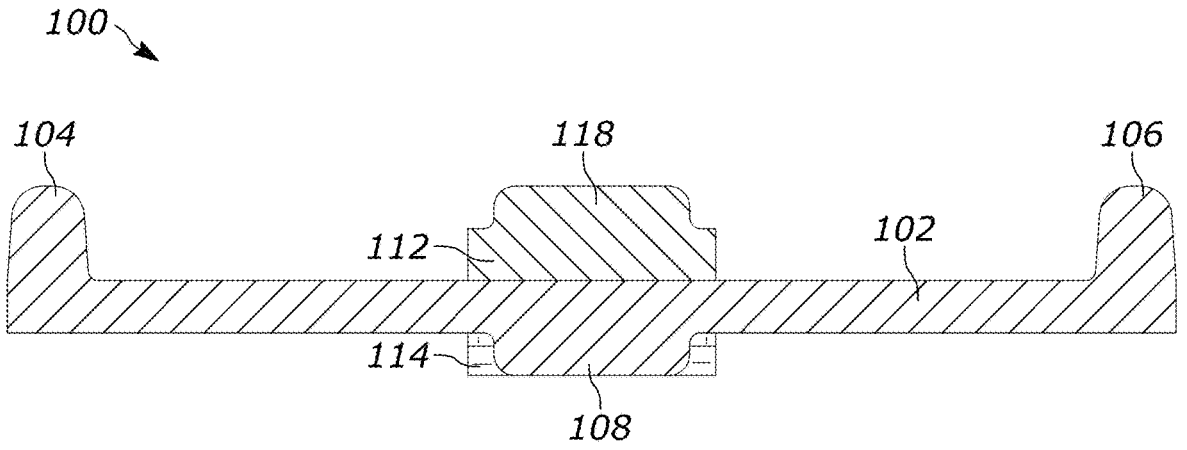
FIG. 10 is a front elevation section view of FIG. 1 along section lines 8-8.

As illustrated the example embodiment of FIG. 9, the bosses 108, 118 and the members 102, 112 combine to have a clip height 120. In one example embodiment, the clip height 120 is 0.180" inches having a range between +/−0.005" inches. The clip height 120 is approximately equal to the central height 212 of the muntin bar 202. (see FIG. 19). In another example embodiment, the clip height 120 is between 105% to about 95% of the central height 212 of the muntin bar 202. (see FIG. 19). In one example embodiment, diameters 108*b*, 118*b* illustrated in FIGS. 7-8 of the bosses 108, 118 are less than or equal to the central width 218 of the muntin bar 202 in which the clip 100 is intended to be used.

The clip 100 in one example embodiment is made from a polymer. In another example embodiment, the clip 100 is fabricated by a molding operation, such as injection, molding, functional 3 dimensional (3D) printing, multi-cavity molding, or any combination thereof. In yet another example embodiment, the clip 100 is a molded plastic.

Figure 11A:
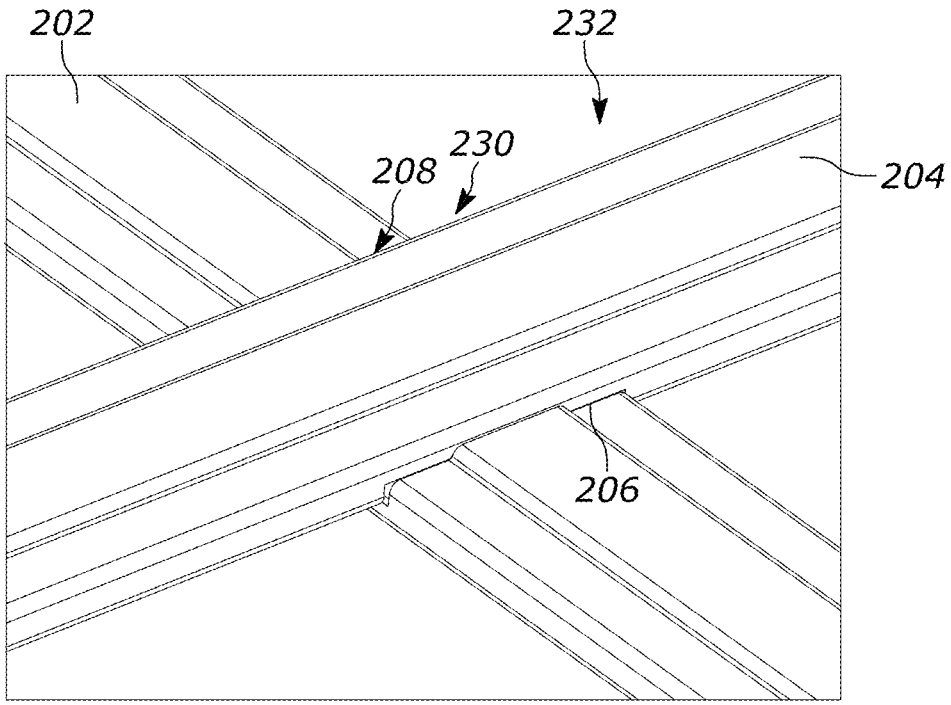
FIG. 11A is a perspective view of assembled muntin bars cross joined by the muntin cross joiner clip.
Figure 11B:
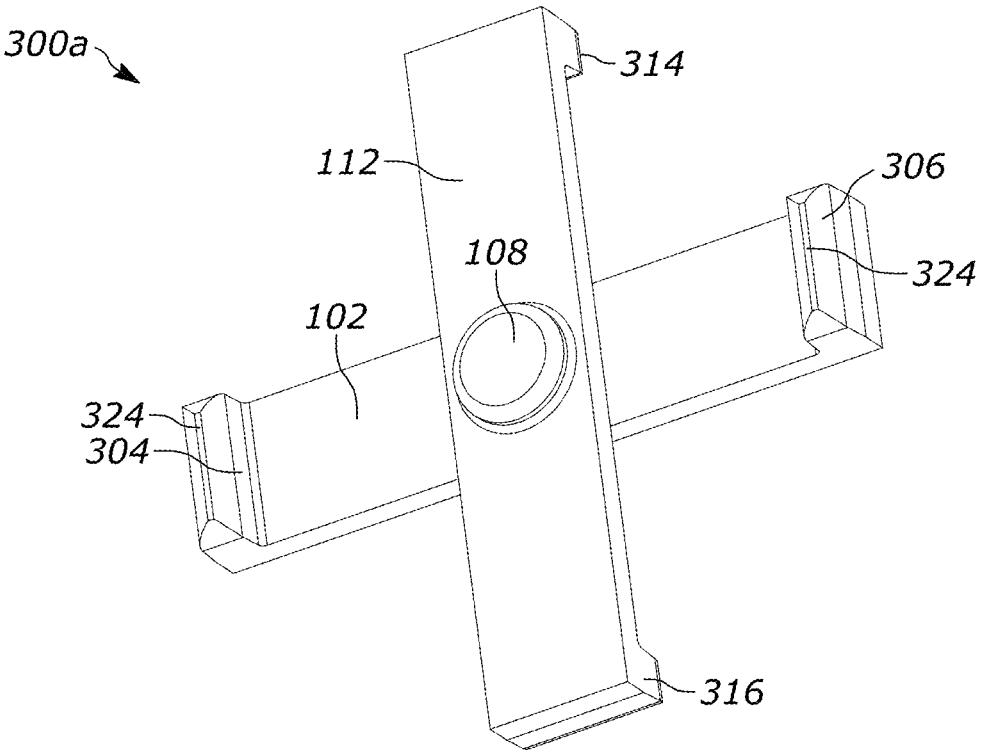
FIG. 11B is a top perspective view of a muntin cross joiner clip in accordance with a second example embodiment of the present disclosure.
Figure 15:
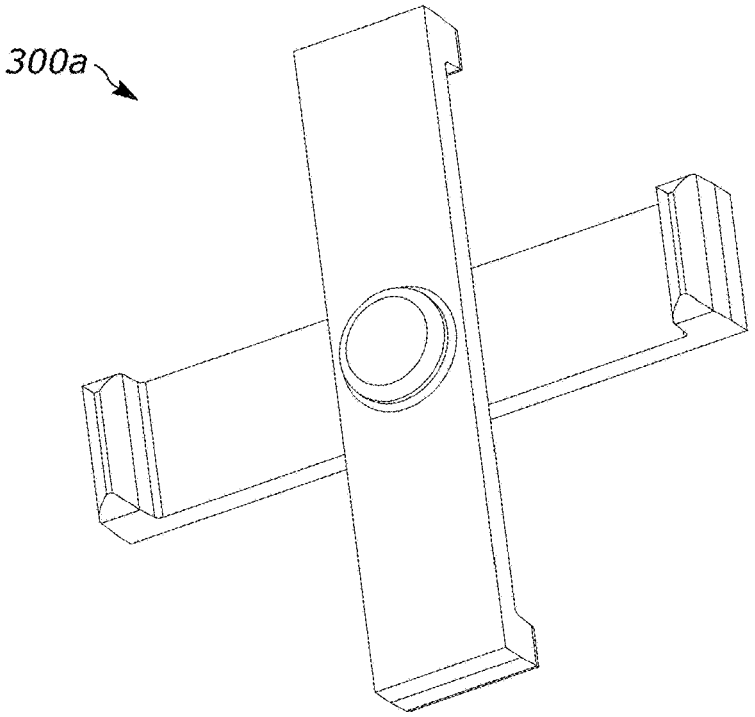
FIG. 15 is a top perspective view of a muntin cross joiner clip in accordance with a second example embodiment of the present disclosure.
Figure 16:
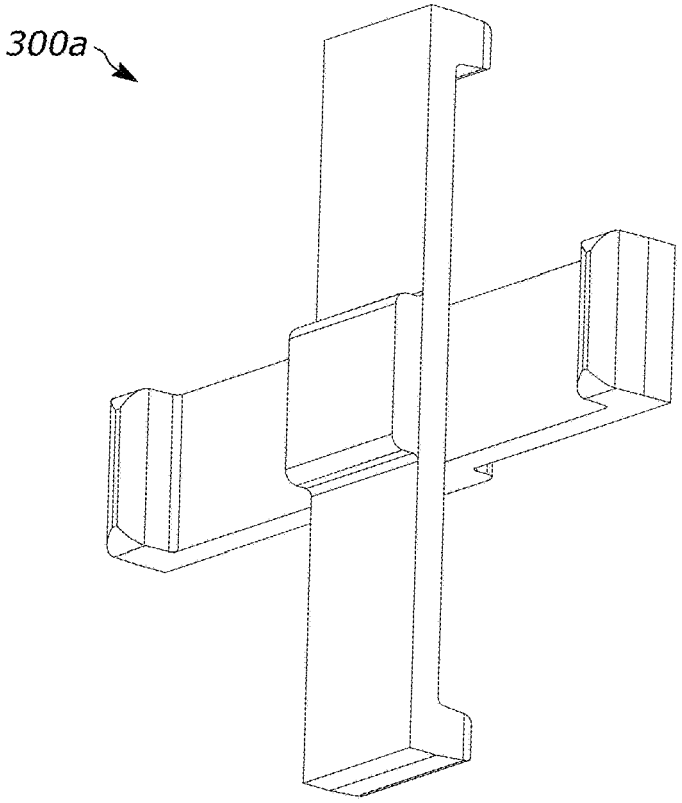
FIG. 16 is a top perspective view of a muntin cross joiner clip in accordance with a third example embodiment of the present disclosure.
Figure 17:
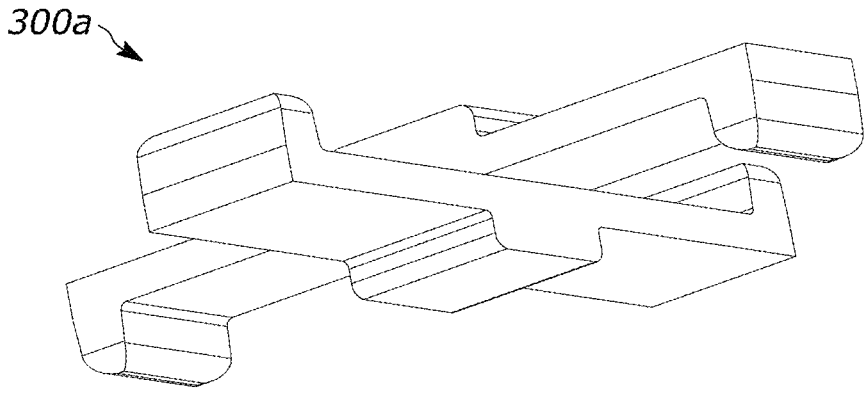
FIG. 17 is a side bottom perspective view of FIG. 17.

Referring now to FIGS. 11B and 15, a second example embodiment of a clip 300*a* is shown having angular first, second, third, and fourth arms 304, 306, 314, 316. Further, in FIGS. 12A-12B, 16-17 and 21, a third example embodiment of a clip 300*b* is illustrated having square bosses 308, 318. Features of the clips 300*a*, 300*b* illustrated in FIGS. 11B and 15 and FIGS. 12A-12B, 16-17 and 21 that are different than the features of the clip 100 illustrated in FIGS. 3-10 will be identified by like numerals increased by a factor of two hundred. In the example embodiment of the clips 300*a*, 300*b* first, second, third, and fourth arms 304, 306, 314, 316 are illustrated as having planar surfaces 324 at a location extending farthest from the non-contact surface 102*b*, 112*b* rather than rounded surfaces. In this example embodiment, the first, second, third, and fourth arms 304, 306, 314, 316 tactilely interact when in use with first or second muntin bars 202, 204 along the planer surfaces 324.

In the example embodiment of FIGS. 12A-12B, 16-17 and 21, the square bosses 308, 318 interact with the muntin bars 202, 204 when in use. In one example embodiment, the square bosses 308, 318 have a boss width 318*b* that is less than or equal to the central width 218 of the muntin bars 202, 204. In another example embodiment, the square bosses 308, 318 have beveled edges 322 along two opposing sides, and a sharp edge along the other two opposing sides. In this example embodiment, the beveled edges extend along the y-axis on the second boss 318, and along the x-axis on the first boss 308. In another example embodiment, one, two, three or four edges of the square boss 308, 318 are beveled (not shown). In yet another example embodiment, one, two, three or four edges of the square boss 308, 318 are sharp edges (not shown). It would be understood by one having ordinary skill in the art that rectangular, polygonal, oval, etc. boss shapes have been contemplated.

It can be seen that the clip 100 of the present disclosure includes bosses 108, 118 to eliminate gaps between muntin bars 202, 204 and problems associated therewith created by joiner clips of the prior art. One approach of removing such gaps and problems is by adding the bosses 108, 118 to the central portion 122 of the clip 100. In the illustrated example embodiment, the boss 108, 118 is semi-spherical in shape, but it should be appreciated by those skilled in the art that other geometric shapes of the boss could be use without departing from the spirit and scope of the present disclosure.

Illustrated in the example embodiment of FIGS. 21-26 is the clip 100 being inserted into the notches 206, 216 of the first and second muntin bars 202, 204. FIGS. 22-26 illustrate a cross-section of the first muntin bar 202, wherein the seam 210 is omitted for clarity. In this example embodiment, the notches 206, 208 have a depth 204*a*, 206*a*, respectively, that are 50% of the overall depth 204*b*, 206*b* of the muntin bars 202, 204. (see FIGS. 19A-19B). In one example embodiment, the notches 206, 208 are formed along the seam 210. Wherein, the muntin bars 202, 204 are notched prior to roll forming, as the notch depth 206*a*, 206*b* is greater than or equal to 50% of the overall depth 204*b*, 206*b* of the muntin bars.

Figure 22:
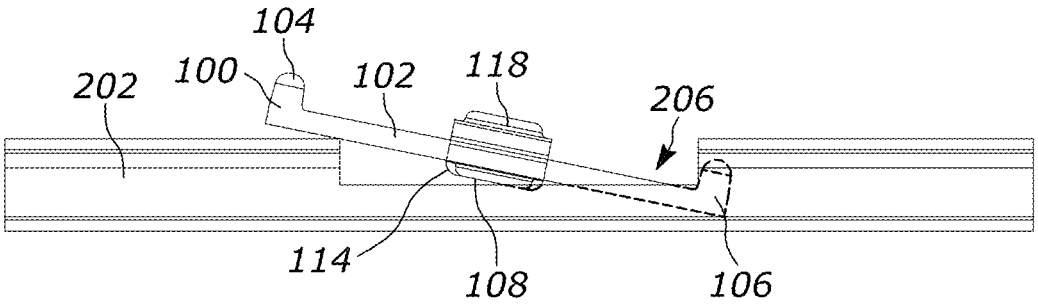
FIG. 22 is cross-section view of a muntin cross joiner clip as illustrated in FIG. 7 being inserted into a first muntin bar taken along lines 22-22 of FIG. 21.

The clip 100 is slid into the first notch 206, wherein one of the first or second arms 104, 106 is inserted such that the first and second arms extend away from the notch. For clarity, the insertion will be described specifically referring to either the first or second arm 104, 106, while it is understood that either the first or second arm may be inserted first or second. As illustrated in FIG. 22, the longitudinal member 102 of the clip 100 is inserted into the first notch 206 and slid in a first insertion direction until the second arm 106 is within an un-notched portion 207 of the first muntin bar 202. In another example embodiment, the longitudinal member 102 of the clip 100 is inserted into the first notch 206 until the longitudinal member resides within the first notch 206. The second arm 106 interacts with the second internal surface 220*b* of the un-notched portion 207 of the first muntin bar 202.

Figure 23:
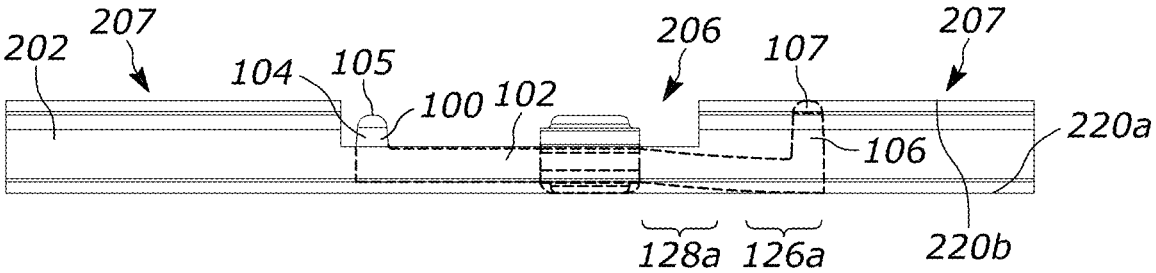
FIG. 23 is cross-section view of a muntin cross joiner clip as illustrated in FIG. 22 being further inserted into a first muntin bar.

Referring now to FIG. 23, the longitudinal member 102 is within the first notch 206 and one arm is within the un-notched portion 207 of the first muntin bar 202. The edge 107 of the second arm 106 is interacting with the second internal surface 220*b* of the muntin bar 202 and the first boss 108 is in contact with the second internal surface 220*b*, which pushes a first lateral portion 126*a* of the contact portion 102*a* of the longitudinal member 102 into contact with the first internal surface 220*a* of the first muntin bar 202. A first medial portion 128*a* of the longitudinal arm 102 is flexed or arced, creating tension between the first boss 108 and the first internal surface 220*a* and the second arm 106 and the second internal surface 220*b*.

Figure 24:
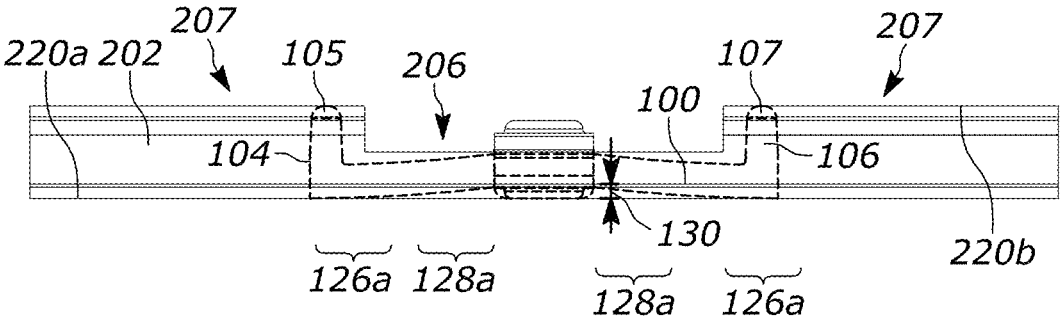
FIG. 24 is cross-section view of a muntin cross joiner clip as illustrated in FIG. 22 inserted into a first muntin bar.

Referring now to FIG. 24, the longitudinal member 102 is within the first notch 206 and both the first and second arms 104, 106 are within the un-notched portions 207 of the first muntin bar 202. The edge 105 of the first arm 104 is interacting with the second internal surface 220*b* of the muntin bar 202 and the first boss 108 remains in contact with the first internal surface 220*a*, which pushes a second lateral portion 126*b* of the contact portion 102*a* of the longitudinal member 102 into contact with the first internal surface 220*a* of the first muntin bar 202. A second medial portion 128*b* of the longitudinal arm 102 is flexed or arced, creating tension between the first boss 108 and the first internal surface 220*a* and the first arm 104 and the second internal surface 220*b*. The tension generated between the interaction of the edges 105, 107, the first boss 108 and the first and second internal surfaces 220*a*, 220*b* retains the clip 100 within the first notch 206. When in use the contact portions 102*a* of the medial portions 128*a*, 128*b* are separated from the first internal surface 220*a* a boss distance 130. The boss distance 130 is largest nearest the first boss 108 and decreases until contact is made with the first internal surface 220*a* at the first and second lateral portions 126*a*, 126*b*.

Figure 25:
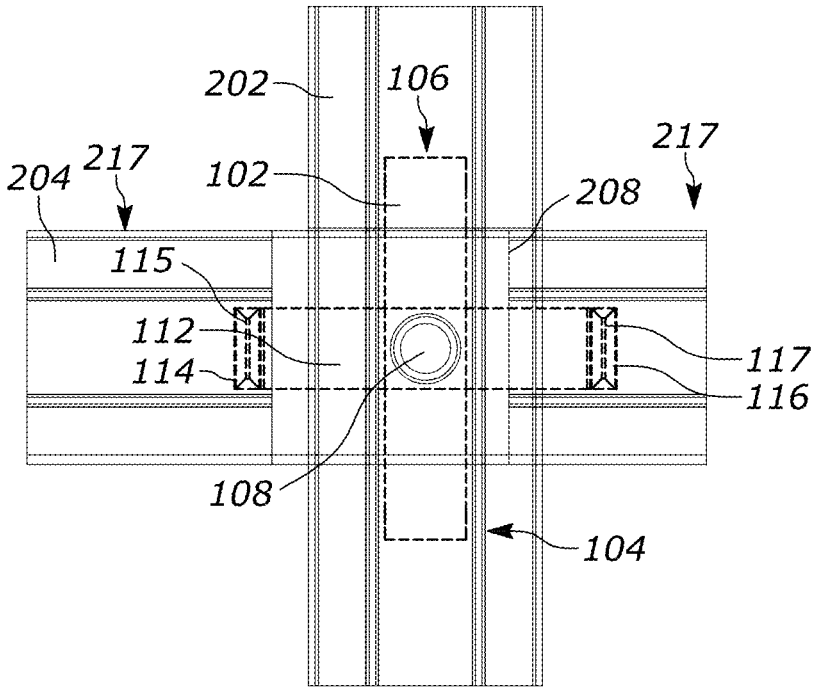
FIG. 25 is a muntin view of a muntin cross joiner clip inserted into a first muntin bar being inserted into a second muntin bar.

Referring now to FIG. 25, the first muntin bar 202 of FIG. 24 is viewed from a top plan view, and the second muntin bar 204 is in the process of being attached. The clip 100 is slid into the second notch 208 of the second muntin bar 204 wherein one of the third or fourth arms 114, 116 is inserted into the second notch 208 such that the third and fourth arms extend away from the notch. For clarity, the insertion will be described as specifically referring to either the third or fourth arms 114, 116, while it is understood that either the third or fourth arms 114, 116 may be inserted first or second. Further it is understood that the lateral member 112 supporting the third or fourth arms 114, 116 may be inserted into the first notch 206 of the first muntin bar, and that the longitudinal member 102 supporting the first or second arms 104, 106 could function as the third or fourth arms 114, 116 that are being described with regard to FIGS. 25-26.

As illustrated in FIG. 25, the lateral member 112 of the clip 100 is inserted into the second notch 208 and slid in the first insertion direction until the third arm 114 is within an un-notched portion 217 of the second muntin bar 204. The clip 100 is coupled to the first muntin bar 202 via the first notch 206. In another example embodiment, the lateral member 112 of the clip 100 is inserted into the second notch 208 until the lateral member resides within the second notch 208. The third arm 114 interacts with the second internal surface 220*b* of the un-notched portion 217 of the second muntin bar 204.

Figure 26:
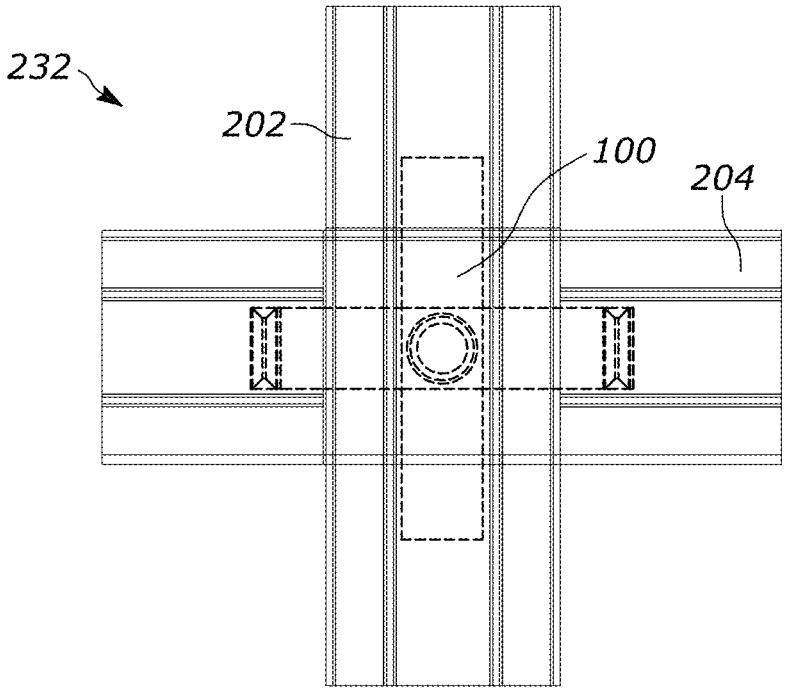
FIG. 26 is a plan view of a muntin cross joiner clip in use with a first and second muntin bar.

Referring now to FIG. 26, the lateral member 112 is within the second notch 206 and both the third and fourth arms 114, 116 are within the un-notched portion 217 of the second muntin bar 204. The edge 115 of the third arm 114 is interacting with the second internal surface 220*b* of the muntin bar 204 and the second boss 118 remains in contact with the first internal surface 220*a*, which pushes a second lateral portion 126*b* of the contact portion 112*a* of the lateral member 112 into contact with the first internal surface 220*a* of the second muntin bar 204. As illustrated in the example embodiment of FIG. 20B, a second medial portion 138*b* of the lateral member 112 is flexed or arced, creating tension between the second boss 118 and the first internal surface 220*a* and the third arm 114 and the second internal surface 220*b*. The tension generated between the interaction of the edges 115, 117, the second boss 118 and the first and second internal surfaces 220*a*, 220*b* retains the clip 100 within the second notch 208 to couple the first muntin bar 202 to the second muntin bar 204 without shadowing at the connection locations. When in use, the contact portions 112*a* of the medial portions 138*a*, 138*b* are separated from the first internal surface 220*a* a second boss distance 132. The second boss distance 132 is largest nearest the second boss 118 and decreases until contact is made with the first internal surface 220*a* at the first and second lateral portions 136*a*, 136*b*.

Figure 20A:
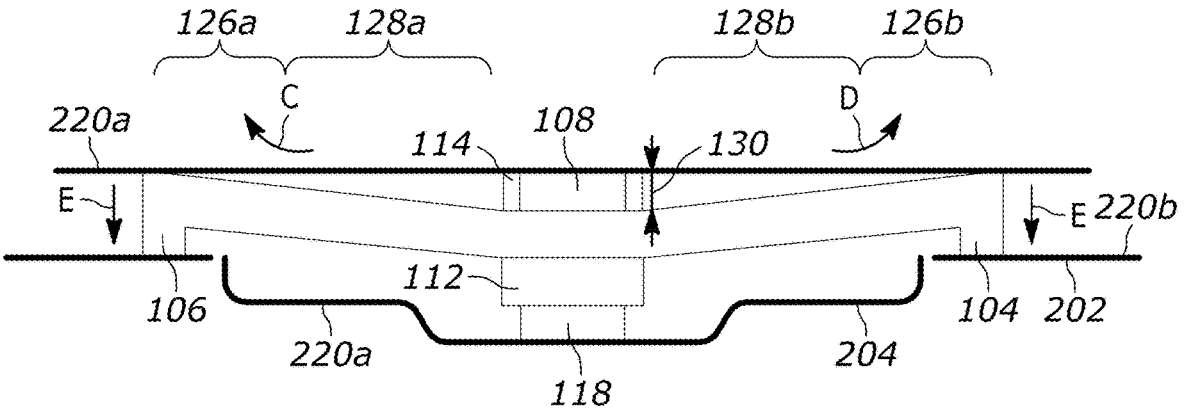
FIG. 20A is a cross-section view of FIG. 18 taken along section line 20A-20A.

An example interaction of the longitudinal arm 102 and the first and second bosses 108, 118 with the first and second muntin bars 202, 204 is illustrated in FIG. 20A. The interaction of the second boss 118 with the second internal surface of the second muntin bar 204 maintains a height of the second muntin bar relative to the first muntin bar 202, wherein the interaction of the first boss 108 with the first internal surface 220*a* of the first bar provides support for the second boss. The longitudinal arm 102 flexes in a first flex direction indicated by arrow C and a second flex direction indicated by arrow D. The flex is responsive to the interaction of the first and second arms 104, 106 with the second internal surface 220*b* of the first muntin bar 202 which applies pressure to the first muntin bar in direction E, which simultaneously applies pressure to the first boss 108. In one example embodiment, the pressure applied in direction E maintains the first boss 108 in contact with the first internal surface 220*a* of the second muntin bar 204 during use.

Figure 20B:
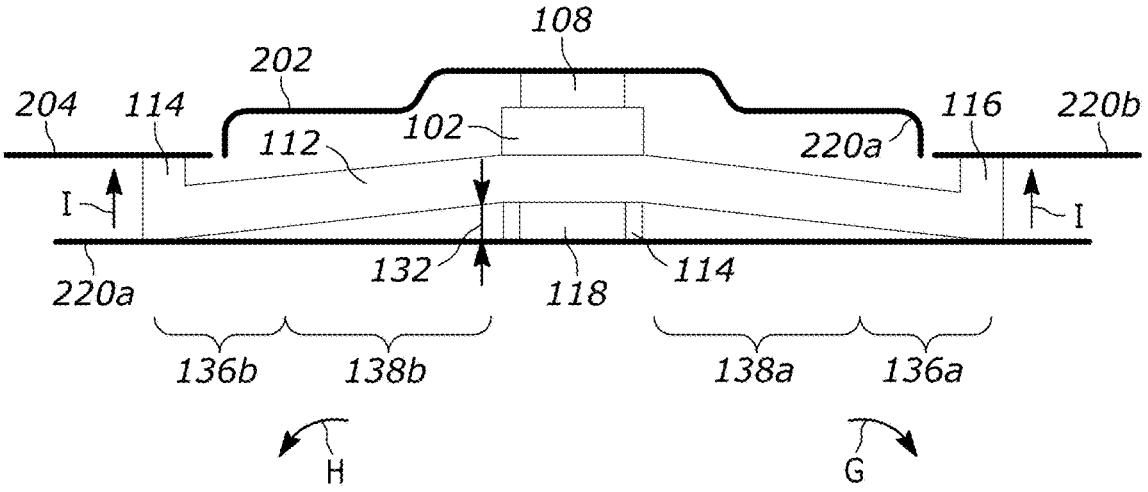
FIG. 20B is a cross-section view of FIG. 18 taken along section line 20B-20B.
Figure 21:
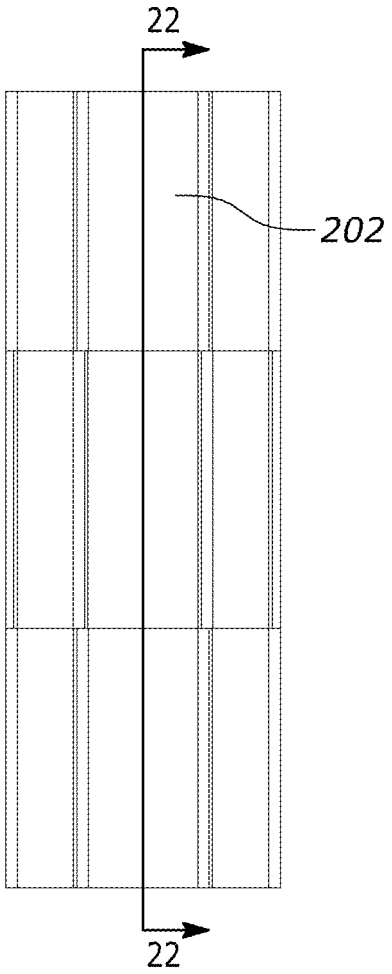
FIG. 21 is a plan view of a first muntin bar.

Similarly, in FIG. 20B, an example of the lateral arm 112 and the first and second bosses 108, 118 interacting with the first and second muntin bars 202, 204 is illustrated. The interaction of the first boss 108 with the first internal surface 220*a* of the first muntin bar 206 maintains a height of the first muntin bar relative to the second muntin bar 204, wherein the interaction of the second boss 118 with the first internal surface 220*a* of the second muntin bar provides support for the first boss. The lateral arm 112 flexes in a third flex direction indicated by arrow H which when the clip 100 is in use. The third flex direction indicated by arrow H is opposed to the first flex direction indicated by arrow C. The lateral arm 112 flexes further in a fourth flex direction indicated by arrow G which when the clip 100 is in use, is opposed to the second flex direction indicated by arrow D. The flex is responsive to the interaction of the third and fourth arms 114, 116 with the second internal surface 220*b* of the second muntin bar 204 which applies pressure to the second muntin bar in direction I, which simultaneously applies pressure to the second boss 118. In one example embodiment the pressure applied in direction I maintains the second boss 118 in contact with the first internal surface 220*a* of the first muntin bar 202 during use.

Figure 27:
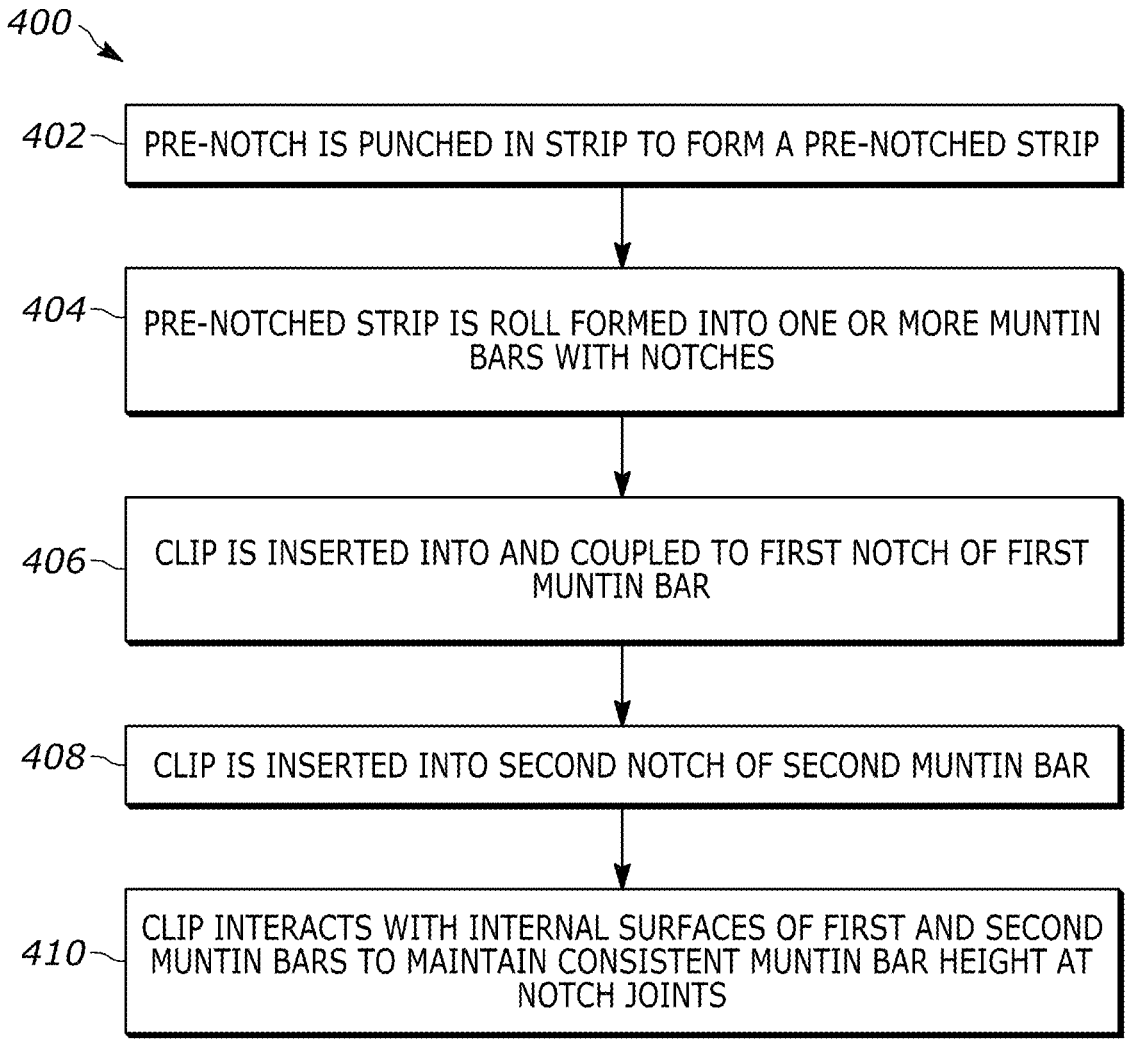
FIG. 27 is a schematic view of a method of forming a grid in a window assembly.

Illustrated in FIG. 27 is an example method 400 of forming and assembling the grid 232. At 402, a pre-notch is punched into a strip (e.g., a strip of metal) to form a pre-notched strip. At 404, the pre-notched strip is roll formed into one or more muntin bars 202, 204, with notches 206, 208. At 406, the clip 100 is inserted into and coupled to the first notch 206 of the first muntin bar 202 as illustrated in FIGS. 22-24. At 408, the clip 100, being coupled to the first muntin bar 202, is inserted into and coupled to the second notch 208 of the second muntin bar 204 as illustrated in FIGS. 25-26. At 410, the clip 100 interacts with internal surfaces 220 of the first and second muntin bar 202, 204 as illustrated in FIGS. 20A, 20B, to maintain a consistent bar height at the joint 230 of the notches 202, 204.

The clip 100 advantageously maintains the height of the muntin bars 202, 204 relative to each other irrespective of the notch height 204*a*, 206*a*. Further, as the clip 100 allows a user to pre-notch and then roll form the strip to form the muntin bar 202, 204, the muntin bars can be formed continuously, with minimal waste, as the strip can be pre-notched, roll formed, and cut to whatever length the user needs.

The current design of the clip 100 and muntin bars 202 and 204 advantageously are more efficiently assembled and aesthetically pleasing over the prior art. Muntin bars of the prior art all required to be first preformed then be cut to measure, and the excess or cut portions are wasted. Additionally, the clip 100 removes the need for time consuming and costly manual cutting of the notches to remove the aesthetically unpleasing shadow, resulting from the cut being less than 50% of the sidewall and lack of stability of the joiner clip.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued. Any document referenced in this disclosure are incorporated by reference in their entireties for all purposes.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. In one non-limiting embodiment the terms are defined to be within for example 10%, in another possible embodiment within 5%, in another possible embodiment within 1%, and in another possible embodiment within 0.5%. The term "coupled" as used herein is defined as connected or in contact either temporarily or permanently, although not necessarily directly and not necessarily mechanically. A device or structure that is "configured" in a certain way is configured in at least that way, but may also be configured in ways that are not listed.

To the extent that the materials for any of the foregoing embodiments or components thereof are not specified, it is to be appreciated that suitable materials would be known by one of ordinary skill in the art for the intended purposes.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A muntin clip comprising:

a body having a longitudinal member and a lateral member, the longitudinal member overlapping said lateral member at a generally central location, the lateral member integrally molded with the longitudinal member;

first and second arms at first and second ends of said longitudinal member and lateral member, said first and second arms diverging on said longitudinal member from said first and second arms on said lateral member; and a boss located on one of said lateral member and said longitudinal member at said generally central location.

2. The muntin clip of claim 1 further comprising a second boss spaced from said first boss.

3. The muntin clip of claim 2 wherein said clip is formed from molded plastic.

4. The muntin clip of claim 1 further comprising a second boss spaced and directly opposed to said first boss, wherein said first boss extends from said lateral member and said second boss extends from said longitudinal member.

5. The muntin clip of claim 4, wherein the lateral member extends along a lateral axis and the longitudinal member extends along a longitudinal axis, the lateral axis perpendicular to the lateral axis.

6. The muntin clip of claim 5 the second boss and the first boss extending away from each other along a third axis that is perpendicular to the lateral axis and the longitudinal axis.

7. The muntin clip of claim 6, the first and second arms at first and second ends of said longitudinal member extend along the third axis in a first direction and the first and second arms at first and second ends of said lateral member extend along the third axis in a second direction, the first direction opposite the second direction.

8. The muntin clip of claim 1 the first and second arms at first and second ends of said longitudinal member extending in a first direction perpendicular to an axis along which the longitudinal member extends.

9. The muntin clip of claim 8 the first and second arms at first and second ends of said lateral member extending in a second direction perpendicular to an axis along which the lateral member extends, the second direction directly opposite the first direction.

10. A method of forming a muntin grid, the method comprising the steps of:

pre-notching a flat strip to form a first and second pre-notched strips;

roll forming the first and second pre-notched strips to from a first and second muntin bars defining first and second notches, respectively, the first and second muntin bars defining a contoured shape comprising first and second lateral sections coupled together and spaced by a raised central section;

inserting a lateral member of a clip into the first notch and coupling the clip to the first muntin bar, the clip having centrally linked lateral and longitudinal members, the lateral member extending along a lateral axis, the longitudinal member extending along a longitudinal axis, the lateral member supporting first and second lateral arms and the longitudinal member supporting first and second longitudinal arms the first and second lateral arms extend along a third axis in a first direction and the first and second longitudinal arms extend along the third axis in a second direction, the first direction opposite the second direction and the longitudinal, lateral and third axis are perpendicular to each other, the longitudinal member coupled to a second boss spaced and directly opposed to a first boss supported by the lateral member, the second boss and the first boss extend away from each other along the third axis; and inserting the longitudinal member into the second notch to couple the first muntin bar to the second muntin bar, wherein the first boss is in contact with a first internal surface of the first muntin bar, and the second boss is in contact with a first internal surface of the second muntin bar when the first muntin bar is coupled to the second muntin bar by the clip.

11. The method of claim 10, the pre-notching comprising removing fifty percent of the flat strip.

12. The method of claim 10, the roll forming comprising forming a seam in the muntin bar, the seam centrally located along the first lateral section.

13. The method of claim 10, wherein the inserting a lateral member comprises aligning the first muntin bar along the lateral axis and inserting the lateral member along a first direction along the lateral axis into the first notch, wherein the first lateral arm is in contact with a second internal surface of the first muntin bar, the second internal surface opposite the first internal surface.

14. The method of claim 13, wherein responsive to the lateral member being inserted in the first notch, a first lateral portion of a contact portion of the lateral member is flexed into contact with the first internal surface of the first muntin bar while a second lateral portion of the contact portion is free from contact with the second internal surface of the first muntin bar, the first lateral portion spacing the second lateral portion from the first lateral arm.

15. The method of claim 14, responsive to the first arm being within the first notch the inserting a lateral member comprises inserting the lateral member along a second direction along the lateral axis into the first notch, the first direction directly opposite the second direction, wherein the second lateral arm comes into contact with the first internal surface of the first muntin bar.

16. The method of claim 15, wherein responsive to the lateral member being inserted in the first notch along the second direction, a second lateral portion of the contact portion of the longitudinal member is flexed into contact with the first internal surface of the first muntin bar, while a second lateral portion the contact portion is free from contact with the first internal surface of the first muntin bar.

17. A muntin grid comprising:

a clip comprising:

centrally linked lateral and longitudinal members, the lateral member extending along a lateral axis, the longitudinal member extending along a longitudinal axis;

first and second lateral arms supported by the lateral member and first and second longitudinal arms supported by the longitudinal member, the first and second lateral arms extend along an arm axis in a first direction and the first and second longitudinal arms extend along the arm axis in a second direction, the first direction opposite the second direction and the longitudinal, lateral and arm axes are perpendicular to each other; and a second boss coupled to the longitudinal member, the second boss spaced and directly opposed to a first boss supported by the lateral member, the second boss and the first boss extend away from each other along a third axis; and a first muntin bar defining a contoured shape comprising first and second lateral sections coupled together and spaced by a raised central section, a first notch defined in the first muntin bar, the clip frictionally retained in the first notch, wherein the first boss and the first and second lateral arms are in contact with internal surfaces of the first muntin bar; and a second muntin bar defining a contoured shape comprising first and second lateral sections coupled together and spaced by a raised central section, a second notch defined in the second muntin bar, the clip frictionally retained in the second notch, wherein the second boss and the first and second longitudinal arms are in contact with internal surfaces of the second muntin bar, the clip being frictionally retained in the first and second notches couples the first and second muntin bars together.

18. The muntin grid of claim 17, the first notch comprising a first notch depth that is less than or equal to about fifty percent of a total depth of the first muntin bar, and the second notch comprising a second notch depth that is less than or equal to about fifty percent of the total depth of the second muntin bar.

19. The muntin grid of claim 17, the first muntin bar comprising first and second internal surfaces within the raised central section, the first and second internal surfaces are directly opposite each other, and the first surface is opposite the first notch, the first and second lateral arms are in contact with the second internal surface of the first muntin bar, and the first boss is in contact with the first internal surface of the first muntin bar.

20. The muntin grid of claim 19, the lateral member comprising a lateral contact portion and a lateral non-contact portion, the first and second arms extend from the lateral non-contact portion and the first boss extends from the lateral contact portion, wherein first lateral portions of the lateral contact portion is flexed into contact with the first internal surface of the first muntin bar while second lateral portions of the lateral contact portion is free from contact with the second internal surface of the first muntin bar, the second lateral portions spacing the first lateral portions from the first boss.

21. The muntin grid of claim 20, the second muntin bar comprising third and fourth internal surfaces within the raised central section, the third and fourth internal surfaces are directly opposite each other, and the third surface is opposite the second notch, the first and second longitudinal arms are in contact with the fourth internal surface of the second muntin bar, and the second boss is in contact with the third internal surface of the second muntin bar, the second boss maintaining location of the second muntin bar relative to the first muntin bar, such that the second muntin bar retains a consistent position relative to the first muntin bar, and the first boss maintaining location of the first muntin bar relative to the second muntin bar, such that the first muntin bar retains a consistent position relative to the second muntin bar.

22. The muntin grid of claim 21, the longitudinal member comprising a longitudinal contact portion and a longitudinal non-contact portion, the first and second longitudinal arms extend from the longitudinal non-contact portion and the second boss extends from the longitudinal contact portion, wherein first longitudinal portions of the longitudinal contact portion is flexed into contact with the first internal surface of the second muntin bar while second longitudinal portions of the lateral contact portion is free from contact with the second internal surface of the second muntin bar, the second longitudinal portions spacing the first longitudinal portions from the second boss.

* * * * *